US005732321A

United States Patent [19]

Ishizuka et al.

[11] Patent Number: 5,732,321

[45] Date of Patent: Mar. 24, 1998

[54] SHEET FEEDING APPARATUS WITH SHEET SUPPORTS ORTHOGONAL TO EACH OTHER

[75] Inventors: Haruo Ishizuka, Kawasaki; Yasushi Ishida, Tokyo, both of Japan

[73] Assignee: Canon Kabushiki Kaisha, Tokyo, Japan

[21] Appl. No.: 751,483

[22] Filed: Nov. 18, 1996

Related U.S. Application Data

[63] Continuation of Ser. No. 260,994, Jun. 16, 1994, abandoned.

[30] Foreign Application Priority Data

Jun. 24, 1993 [JP] Japan ..... 5-153631
Jun. 30, 1993 [JP] Japan ..... 5-160884

[51] Int. Cl.[6] ..... G03G 15/00

[52] U.S. Cl. ..... 399/391; 271/9.06; 271/9.11

[58] Field of Search ..... 399/388, 391, 399/393; 271/9.01, 9.05, 9.06, 9.11, 9.1, 291, 902; 355/200, 308, 309, 311, 205, 207

[56] References Cited

U.S. PATENT DOCUMENTS

| | | | |
|---|---|---|---|
| 4,864,368 | 9/1989 | Muramatsu | 355/309 |
| 4,872,659 | 10/1989 | Kato et al. | 271/9 |
| 4,985,736 | 1/1991 | Kawano et al. | 355/311 |
| 5,049,946 | 9/1991 | Harada | 355/309 |
| 5,052,671 | 10/1991 | Matsuo | 271/9 |
| 5,134,443 | 7/1992 | Sumi et al. | 355/309 |
| 5,191,382 | 3/1993 | Okamura et al. | 355/309 |
| 5,293,203 | 3/1994 | Wada et al. | 355/309 |
| 5,357,329 | 10/1994 | Ariyama et al. | 355/309 |
| 5,383,654 | 1/1995 | Iseda | 271/9 |

*Primary Examiner*—William J. Royer
*Attorney, Agent, or Firm*—Fitzpatrick, Cella, Harper & Scinto

[57] ABSTRACT

A sheet feeder has a feed cassette containing sheets to be supplied to an image forming unit in an image recording apparatus and able to be drawn out of the apparatus through a front portion of the apparatus, and another feed cassette able to be drawn out of the apparatus through a side portion. The feed cassette that can be drawn out through the side portion has a portion projecting outward from the side portion of the apparatus and located below a discharge tray for receiving sheets on which images are formed and which are discharged. This feed cassette can contain sheets having a size larger than the maximum size of recording sheets containable in the feed cassette drawn out through the front portion.

37 Claims, 17 Drawing Sheets

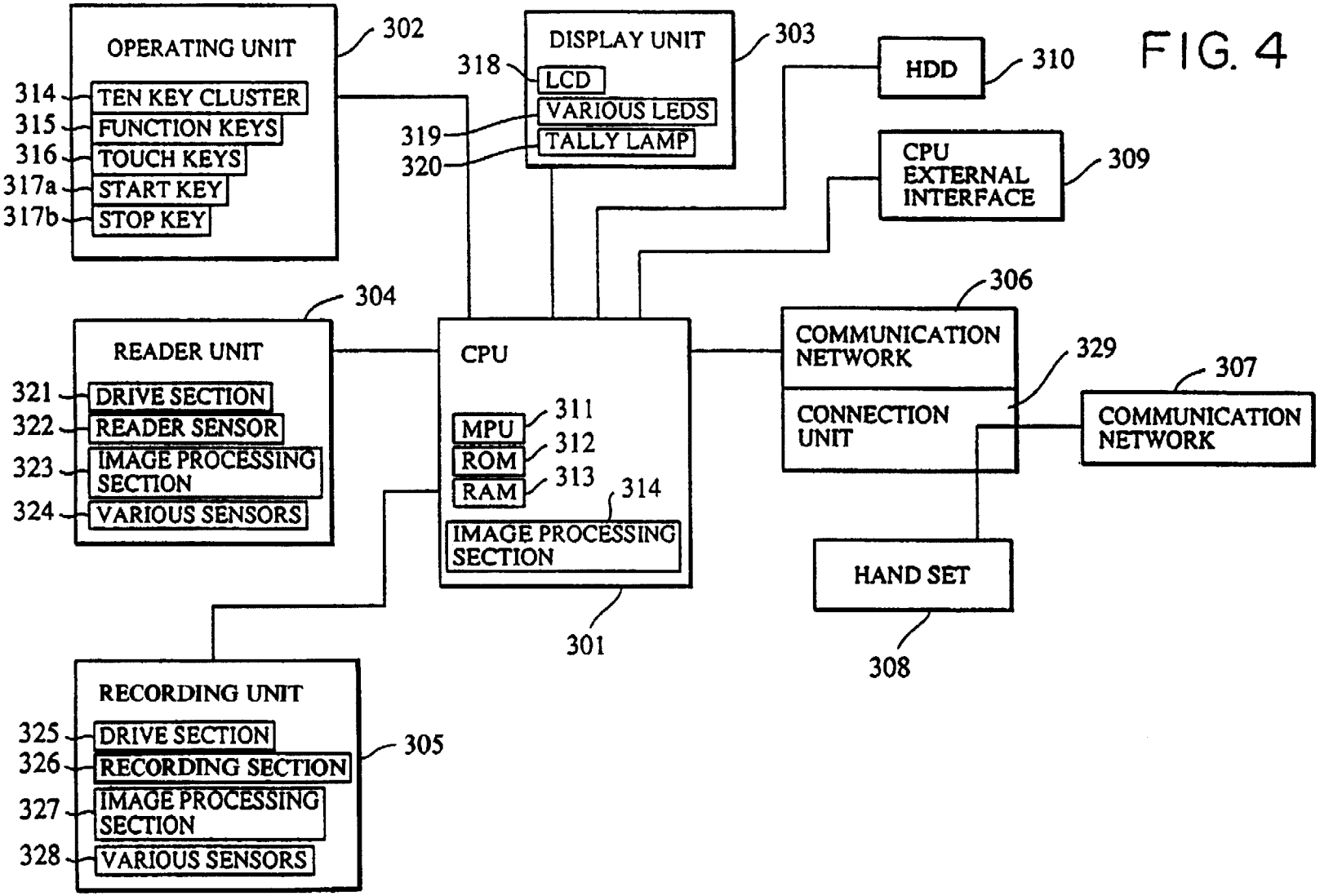
FIG. 4
HDD
310
CPU EXTERNAL INTERFACE
309
COMMUNICATION NETWORK
307
COMMUNICATION NETWORK
306
CONNECTION UNIT
329
HAND SET
308
DISPLAY UNIT
303
LCD
VARIOUS LEDS
TALLY LAMP
318
319
320
CPU
MPU
ROM
RAM
311
312
313
314
IMAGE PROCESSING SECTION
301
OPERATING UNIT
302
TEN KEY CLUSTER
FUNCTION KEYS
TOUCH KEYS
START KEY
STOP KEY
314
315
316
317a
317b
READER UNIT
304
DRIVE SECTION
READER SENSOR
IMAGE PROCESSING SECTION
VARIOUS SENSORS
321
322
323
324
RECORDING UNIT
305
DRIVE SECTION
RECORDING SECTION
IMAGE PROCESSING SECTION
VARIOUS SENSORS
325
326
327
328

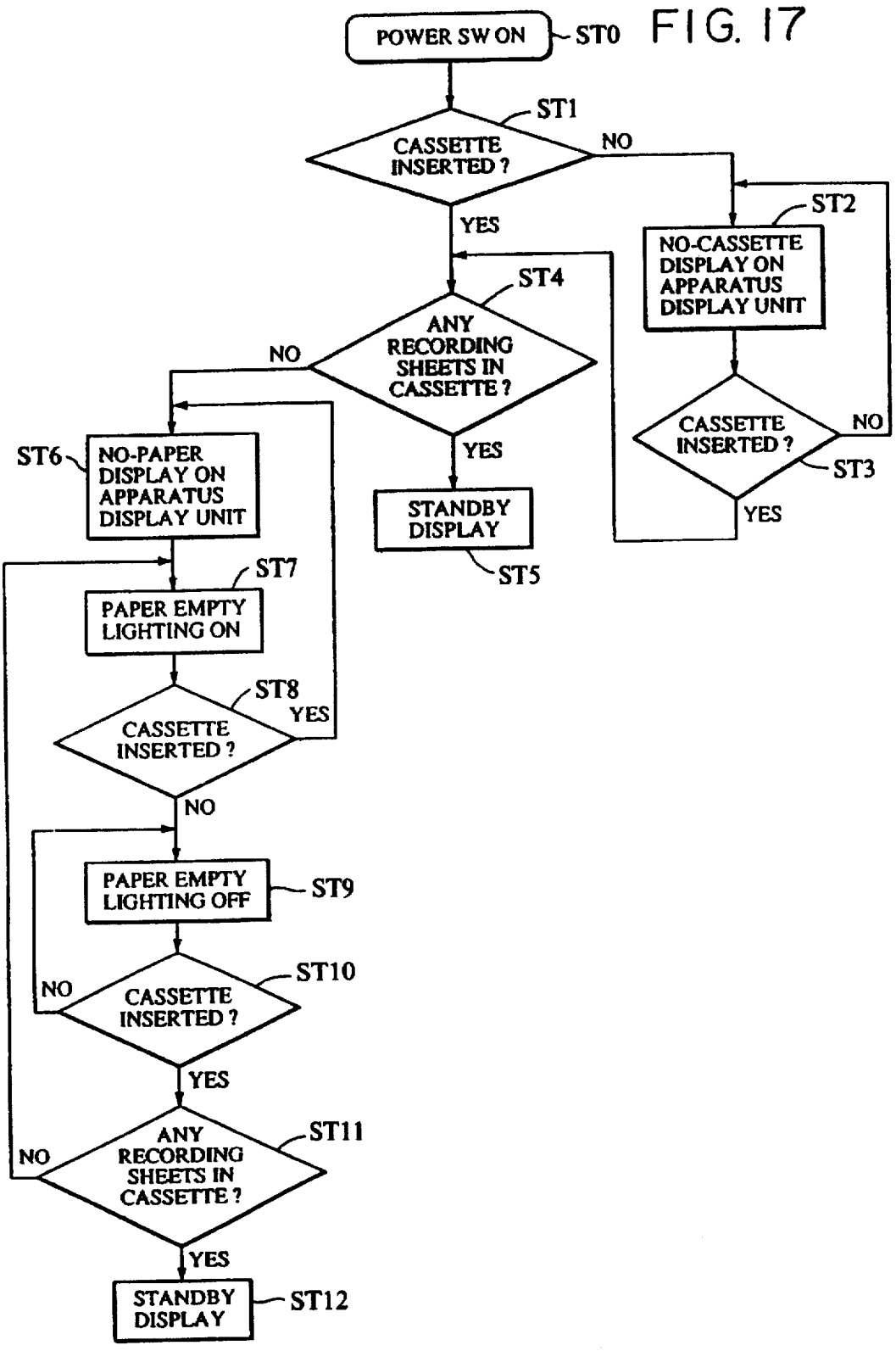
FIG. 17
POWER SW ON
ST0
ST1
CASSETTE INSERTED ?
NO
YES
ST2
NO-CASSETTE DISPLAY ON APPARATUS DISPLAY UNIT
ST4
ANY RECORDING SHEETS IN CASSETTE ?
NO
YES
CASSETTE INSERTED ?
NO
ST3
YES
STANDBY DISPLAY
ST5
ST6
NO-PAPER DISPLAY ON APPARATUS DISPLAY UNIT
ST7
PAPER EMPTY LIGHTING ON
ST8
CASSETTE INSERTED ?
YES
NO
PAPER EMPTY LIGHTING OFF
ST9
ST10
CASSETTE INSERTED ?
NO
YES
ST11
ANY RECORDING SHEETS IN CASSETTE ?
NO
YES
STANDBY DISPLAY
ST12

SHEET FEEDING APPARATUS WITH SHEET SUPPORTS ORTHOGONAL TO EACH OTHER

This is a continuation of Application No. 08/260,994, filed Jun. 16, 1994, now abandoned.

BACKGROUND OF THE INVENTION

1. Field of the Invention

This invention relates to a facsimile machine, a copying machine, a printer or the like in which information is recorded on a recording sheet supplied from a recording sheet cassette mounted on the machine.

2. Description of the Related Art

Conventional recording sheet cassettes (hereinafter referred to as feed cassettes) which are used in image recording apparatuses, e.g., facsimile machines, are inserted into the apparatus body in a direction through a side portion of the apparatus body, as in the case of an image recording apparatus 101 shown in FIG. 9, or in a direction through a front portion of the apparatus body, as in the case of an image recording apparatus 102 shown in FIG. 10.

Some cassettes of this kind have a paper discharge cover 107, such as that shown in FIG. 10, which constitutes a paper discharge port through which a recording sheet on which information has been recorded is discharged. The paper discharge cover 107 is arranged so as to be openable to facilitate paper jam recovery. Also, in some cases, a paper discharge tray 108 is attached to the paper discharge cover 107.

The above-described conventional recording apparatuses entail problems described below.

The conventional recording apparatuses require feed cassettes 103 and 104 to be large enough to contain a recording sheet $S_L$ having a maximum feedable size. In the case of the image recording apparatus 101 into which feed cassettes 103 are inserted in a direction through a side portion of the apparatus, a large installation space is required to allow for the lateral projection of the feed cassettes 103, as shown in FIG. 9. In the case of the image recording apparatus 102 into which feed cassettes 104 are inserted in a direction through a front portion of the apparatus, the overall size of the apparatus is increased to accommodate the size of the feed cassettes 104.

Cases where a large number of maximum size recording sheets $S_L$ are alone used are not common, and it is inconvenient to use the feed cassettes 103 or 104 to load smaller size recording sheets $S_S$, because the feed cassettes 103 or 104 adapted to the larger size recording sheets $S_L$ are large and heavy. Also, maximum-size recording sheet $S_L$, which are not used frequently, fully occupy one of feed cassettes 103 or 104, each of which is adapted for accommodation of a large number of sheets by considering small-size recording sheets $S_S$ used frequently.

Further, if the paper discharge tray 108 is attached to the paper discharge cover 107, there is a possibility that recording sheets S will fall from the tray 108 if the paper discharge cover 107 is inadvertently opened, as shown in FIG. 10.

SUMMARY OF THE INVENTION

In view of the above-described problems, an object of the present invention is to provide a smaller recording apparatus on which a cassette containing recording sheets having a large size can be loaded.

To achieve this object, according to the present invention, there is provided an image recording apparatus for recording images on recording sheets fed from each of recording sheet container cassettes set on a plurality of stages, wherein at least one of the plurality of recording sheet container cassettes can be inserted into a body of the recording apparatus in a direction through a side portion of the apparatus body, while the other recording sheet container cassettes can be inserted into the apparatus body in a direction through a front portion of the apparatus body.

In this arrangement allowing the recording sheet container cassettes to be inserted both through front and side portions, recording sheets having a larger size are contained in the recording sheet container cassette inserted through a side portion. Therefore there is no need to increase the size of the recording sheet container cassette inserted through a front portion according to the larger sheet size.

In accordance with these objects, there is provided a sheet feeding apparatus for supplying sheets to an image recording device, comprising first sheet supporting means for supporting sheets to be supplied to the image recording device, the first sheet supporting means mountable to the image recording device so as to be insertable in and drawable from the image recording device, and second sheet supporting means for supporting sheets to be supplied to the image recording device, the second sheet supporting means mountable to the image recording device so as to be insertable in and drawable from the image recording device in a direction orthogonal to the inserting and drawing out direction of the first sheet supporting means, and at a different elevation from the first sheet supporting means.

In accordance with another aspect of the invention there is provided a sheet feeding apparatus for supplying sheets to an image recording device, comprising first sheet supporting means mountable to the image recording device so as to be insertable in and drawable from the image recording device, sheet feeding means for feeding sheets supported on the first sheet supporting means in the same direction as the direction of mounting, and a sheet supply unit detachably attached to a lower portion of the image recording device and having second sheet supporting means mountable to the image recording device to be drawable from the image recording device in a direction orthogonal to a direction of mounting of the first sheet supporting means.

In accordance with yet another aspect of the invention, there is provided an image recording apparatus which includes sheet feeding apparatus of the type described above in combination with a transport means for transporting sheets fed out of the sheet feed apparatus and image recording means for recording and image on each sheet transported by the sheet transport means.

These and other aspects of the invention will become more apparent in view of the following detailed description of the invention.

BRIEF DESCRIPTION OF THE DRAWINGS

FIG. 4 is a block diagram of a control system of the facsimile machine shown in FIG. 1;

FIG. 17 is a flowchart of a process of controlling the display; and

DESCRIPTION OF THE PREFERRED EMBODIMENT

The entire construction of a facsimile machine, i.e., a recording apparatus in accordance with an embodiment of the present invention, will first be described schematically with reference to FIGS. 1 through 3.

Figure 1:
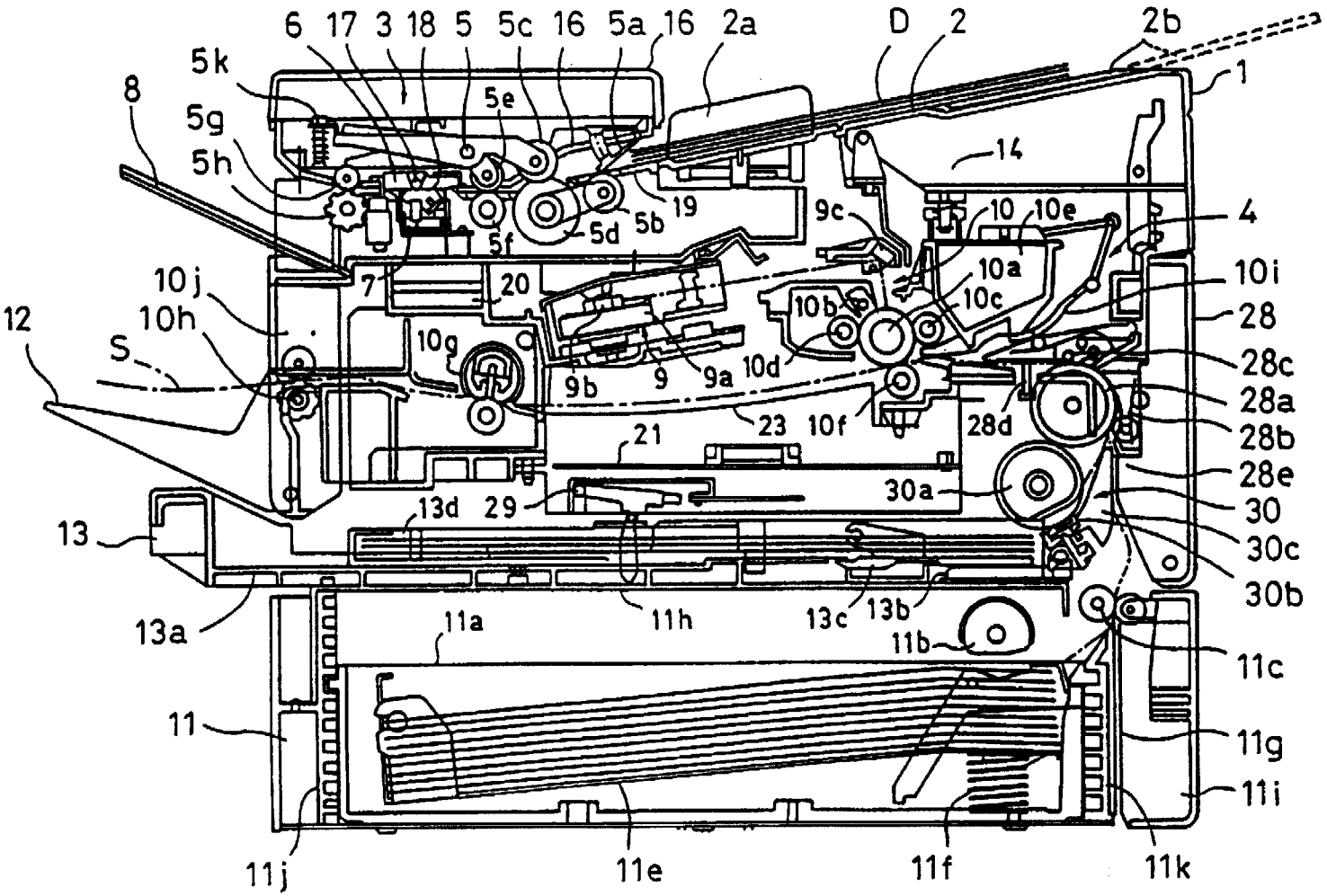
FIG. 1 is a longitudinal sectional view of a facsimile machine in accordance with the present invention.
Figure 2:
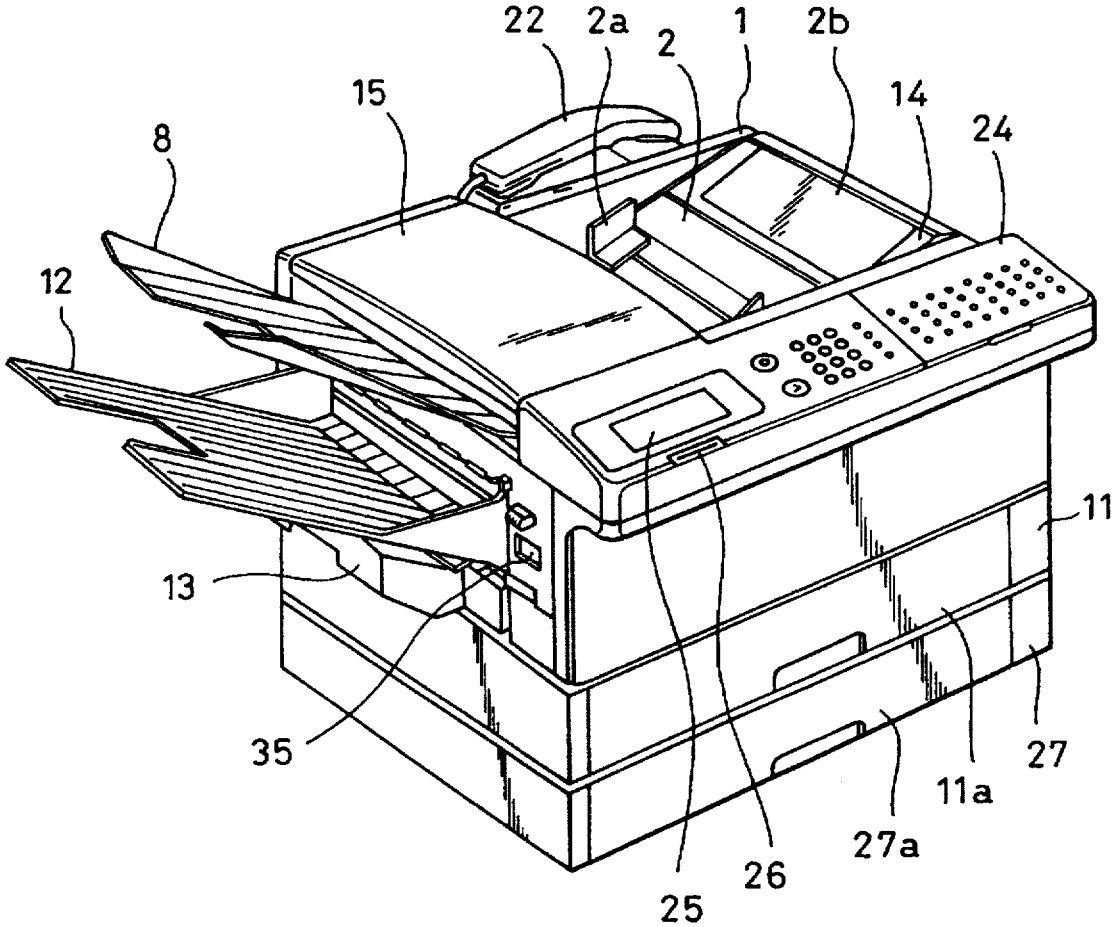
FIG. 2 is a perspective view of the facsimile machine shown in FIG. 1.
Figure 3:
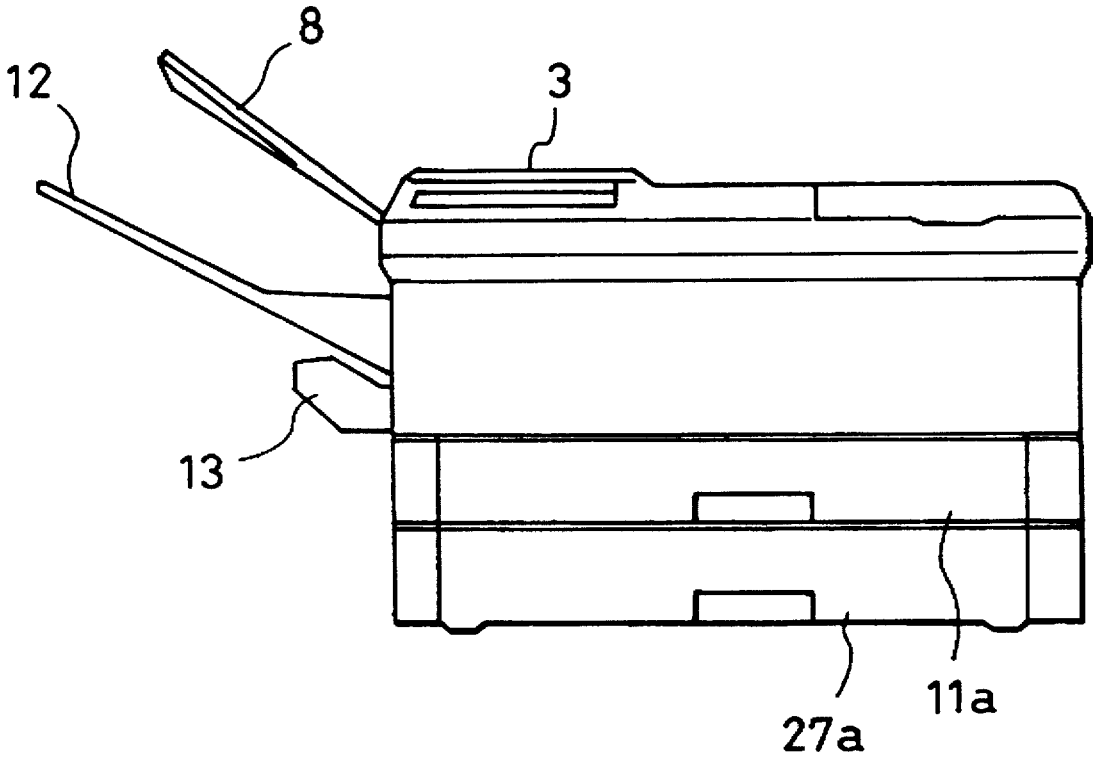
FIG. 3 is a front view of the facsimile machine shown in FIG. 1.

Referring to FIGS. 1 through 3, the apparatus has a body 1, an original table 2 constructed as a top cover of the body 1 so that a plurality of originals D can be placed thereon, an image reader unit 3 for reading information from each original D, a recording unit 4 formed of a laser beam printer, an original transport unit 5, an original pressing unit 6, a close-contact type image sensor 7, an original discharge tray 8, a laser scanner 9, an image forming unit 10, a cassette feeder unit 11, a recording sheet discharge tray 12, a multiple recording paper (MP) cassette unit 13, a cartridge cover 14, an automatic original feeder (ADF) cover 15, an upper original guide 16, a weighting shaft 17, an original pressing plate 18, a lower original guide 19, a partition 20 between the image reader unit and the recording unit, a control unit 21 of the facsimile machine, a handset 22, a transport guide 23, an operating unit 24, a display unit 25, a tally lamp 26 for indicating the operating state of the facsimile machine, a second-stage cassette unit 27, a right cover 28, a multiple recording paper (MP) cassette sensor 29, and a multiple recording paper (MP) separator unit 30.

In the image reader unit 3, originals D placed on the original table 2 are separated and fed one by one by a preliminary transport roller 5*b* pressing against a pressing member 5*a* and a separation roller 5*d* pressing against a reverse roller 5*c*, and are transported to the close-contact type image sensor 7 by transport means including a feed roller 5*f* and a feed roller 5*e* urged against feed roller 5*f* by pressing springs 5*k*. Image information of each original D is read by the close-contact type image sensor 7 while the original D is pressed against the image sensor 7 by the weighting shaft 17 and the original pressing plate 18 in the original pressing unit 6. The original D is thereafter discharged onto the original discharge tray 8 by a paper discharge roller 5*h* and a paper discharge roller 5*g* urged against discharge roller 5*h* by the pressing springs 5*k*. During this transport, each original D is guided by the upper and lower original guides 16 and 19.

Sliders 2*a* which slide in a widthwise direction in relation to original D (perpendicular to the direction of transport of originals D) are provided on the original table 2. Two sides of originals D placed on the original table 2 can be aligned by the sliders 2*a*. If each original D is a lengthwise original, an extension original tray 2*b* may be slid or rotated to prevent rear ends of the originals D from projecting out of the area of the original table 2 and hanging down.

In the recording unit 4, a laser beam oscillator 9*a* of the laser scanner 9 emits a beam of a modulated signal on the basis of an image signal output from the control unit 21, and a photosensitive drum 10*a* in the image forming unit 10 is irradiated with scanning light formed from the modulated beam by a polygon mirror 9*b*, thereby forming image information on a surface of the photosensitive drum 10*a*. The image information is transferred to and fixed on a recording sheet S supplied from the cassette feeder unit 11, the second-stage cassette 27 or the MP cassette unit 13 to the image forming unit 10. Thereafter, the recording sheet S is discharged onto the recording sheet discharge tray 12.

The photosensitive drum 10*a* is incorporated in a recording cartridge 10*e* integrally with a primary charger 10*b*, a development roller 10*c* and a cleaning roller 10*d*. The recording cartridge 10*e* is arranged to be detachable from the recording apparatus body 1. The surface of the photosensitive drum 10*a* is uniformly charged by the primary charger 10*b* and a latent image is formed on the drum surface when the drum surface is irradiated with scanning light from the polygon mirror 9*b* reflected by a return mirror 9*c*. The latent image is developed with a toner supplied from the development roller 10*c*.

A transfer charger 10*f* is disposed on the periphery of the photosensitive drum 10*a* of the image forming unit 10, and a thermal fixation device 10*g* and a paper discharge roller 10*h* are disposed in the recording paper transport path downstream of the photosensitive drum 10*a*.

The toner image formed on the surface of the photosensitive drum 10*a* is transferred to the recording sheet S by the transfer charger 10*f*. Then the recording sheet S is transported along the transport guide 23, and the toner image is fixed by the thermal fixation device 10*g*. Thereafter, the recording sheet S is discharged onto the recording sheet discharge tray 12 by the paper discharge roller 10*h*.

The MP cassette unit 13 is provided in a bottom section of the recording apparatus body 1. Recording sheets S set in the MP cassette 13*a* are pressed against an MP separation roller 30*a* by upward pivotal movement of an MP inner plate 13*c* caused by a pressing member 13*b* and are separated one after another by an MP separation pad 30*b* (frictional member separation method). Each separated recording sheet S is transported along an MP separation base 30*c* and is fed to image forming unit 10 by a transport roller 28*a*, a cover U-turn guide 28*b* provided on the right cover 28 and an apparatus body U-turn guide 28*c* provided on the recording apparatus body 1. During feeding, the position of the leading end of each sheet S is detected by a registration sensor 28*d*, and the paper feed-image output timing is adjusted so that the leading end of the toner image formed on the photosensitive drum 10*a* and the leading end of the recording sheet S coincide with each other. Thereafter, the recording sheet S is transported to the gap between the transfer charger 10*f* and the photosensitive drum 10*a*. Images are recorded on the lower surfaces of recording sheets S set in the MP cassette 13*a*.

An MP limit plate 13*d*, which is attached to the MP cassette so as to be movable for its positioning in accordance with the recording sheet size, limits the positions of surfaces, and rear end surfaces of recording sheets S are brought into abutment against limit plate 13*d* to prevent oblique feeding as well as to prevent failure to successively transport the recording sheets. The size of recording sheets S and the existence or non-existence of recording sheets S are detected by the MP cassette sensor 29. The maximum number of recording sheets held in the cassette is 100. The cassette unit 13 is arranged so that the cassette is drawn out of the recording apparatus body 1 through a left side portion of the same (side loading system). Recording sheets of three sizes, i.e., A4, letter and legal sizes, can be set in the cassette. In FIG. 1, the MP limit plate 13*d* is set in accordance with the A4 size.

The cassette feeder unit 11 is constructed so that its top plate 11*h* is formed as a bottom surface of the recording apparatus body 1. Recording sheets S are supported in the feed cassette 11*a* on an inner plate 11*e* which is urged upwardly by inner plate springs 11*f*. The recording sheets S are separated one after another by a semicircular feed roller 11*b* and a pair of separation claws (claw separation method). Each separated recording sheet S is transported by a pair of cassette transport rollers 11*c*, passed through the gap between the MP separation base 30*c* and a paper passage guide 28*e*, and fed by and around the transport roller 28*a*, the cover U-turn guide 28*b* provided on the right cover 28 and the apparatus body U-turn guide 28*c* provided on the recording apparatus body 1. Thereafter, the recording sheet S is transported in the same manner as the above-described paper feeding from the MP cassette unit 13. The paper paths join to each other immediately before the transport roller 28*a*. Images are recorded on lower surfaces of recording sheets S set in the feed cassette 11*a*.

The second-stage cassette feeder unit 27, not shown in FIG. 1, has substantially the same construction as the illustrated cassette feeder unit 11, and recording sheets S in the second-stage cassette feeder unit 27 are supplied to the recording unit 4 via a side space 11*g* of the cassette feeder unit 11.

The maximum number of recording sheets contained in each of the feed cassettes 11*a* and 27*a* is 500. Each of the feed cassettes 11*a* and 27*a* is arranged so as to be drawn out of the recording apparatus body 1 through a front portion of the apparatus body 1 (front loading system). Recording sheets of two sizes, i.e., A4 and letter sizes, can be set in each cassette.

Each of the cassette feeder unit 11 and the second-stage cassette feeder unit 27 can be separated and connected as an optional unit. The total number of recording sheets that are held may be changed by cassette loading in the recording apparatus from 100 to 1100.

The cartridge cover 14 is openably provided in the recording apparatus body. The cartridge cover 14 is opened to enable the recording cartridge 10*e* to be changed by being drawn out of the recording apparatus body 1.

The cartridge cover 14 has an interlock mechanism which is arranged so that the recording unit 4 does not operate if the cartridge cover 14 is open or if the recording cartridge 10*e* is not set in the recording apparatus body 1. A drum sensation prevention shutter 10*i* provided in the recording cartridge 10*e* is linked to the operation of setting the recording cartridge 10*e* in the recording apparatus body 1. The shutter 10*i* is opened when the recording cartridge 10*e* is set in the recording apparatus body 1 by opening the cartridge cover 14, and is closed when the recording cartridge 10*e* is removed out of the recording apparatus body 1, thereby preventing unnecessary photo-sensation of the photosensitive drum 10*a*.

If a paper jam occurs during recording, at least one of the cartridge cover 14, the right cover 28, the paper discharge cover 10*j* and the jam removal cover 11*i* is opened to remove recording sheets S staying in the recording section and other places.

It is necessary to remove the recording sheet discharge tray 12 before opening the paper discharge cover 10*j*.

The partition 20 is formed as a duct separating the image reader unit 3 and the recording unit 4. Air is caused to flow through the duct by a fan (not shown) to prevent the image reader unit 3 from having its performance impaired by heat generated by the recording unit 4, and to prevent water vapor evaporated from recording sheets S from condensing and dropping onto recording sheets S.

The close-contact type image sensor 7 reads image information by irradiating the image information surface of each original D with light from a light source, i.e., an LED array, and by imaging reflected light from the image information surface on sensor elements through a SELFOC lens.

FIG. 4 is a block diagram of a control system of the facsimile machine in accordance with the present invention, in which a laser beam printer is used. A block 301 in FIG. 4 represents a central processing unit (CPU) for controlling the overall operation of the facsimile machine. The CPU 301 has a microprocessor unit (MPU) 311, a read only memory (ROM) 312 for storing a control program or data for the MPU 311, a random access memory (RAM) 313 used as a working area for processing various kinds of data and as a temporary storage for image information, and an image processing section 314 for performing operations for changing the image magnification and converting the image resolution and other operations. The CPU 301 also has calendar, clock and other known functions. Areas of the RAM 313 where important system setting information, such as touch key address information and software switch information, are stored is protected from a power failure by battery back-up. In the control system of the facsimile machine, the CPU 301 and units 302 to 310 described below are connected through interfaces.

An operating unit 302 includes various key switches, such as a ten key cluster 314, function keys 315, touch keys 316, a start key 317*a*, and a stop key 317*b*. A display unit 303 has a liquid crystal display (LCD) 318 for displaying various messages, various light emitting diodes 319 for indicating transmission modes and for other kinds of indication, and a tally lamp 320 for informing an operator at a remote end of the state of communication and of the occurrence of any machine hindrances.

A reader unit 304 includes a drive section 321 for driving a reading motor or the like, a reader sensor 322 for reading images, an image processing section 323 for shading or binary coding of read image data, and various sensors 324 for detecting originals and for other operations.

A recording unit 305 includes a drive section 325 for driving a recording motor or the like, a recording section 326 for controlling the laser scanner, an electrophotographic process and the like, an image processing section 327 for performing smoothing or the like of recorded images, and various sensors 328 for detecting originals and for other operations. A communication control unit 306 for performing call in and call out coding of image data and other operations has a connection unit 329 formed of a data synchronizer unit (DSU), a network control unit (NCU) and the like. A communication network 307 and a handset 308 are connected to the connection unit 329. A CPU external interface 309 is an interface through which data is directly transmitted or received by the CPU 301, and which is connected to an external computer, for example, in accordance with RS232C, Small Computer System Interface (SCSI), Local Area Network (LAN) or the like to use the facsimile machine as a scanner printer of the external computer. A hard disk drive (HDD) 310 is used as a large-capacity nonvolatile memory for storing image information and the like.

The fundamental operation of the laser beam printer will be described with reference to a schematic illustration of FIG. 5.

Figure 5:
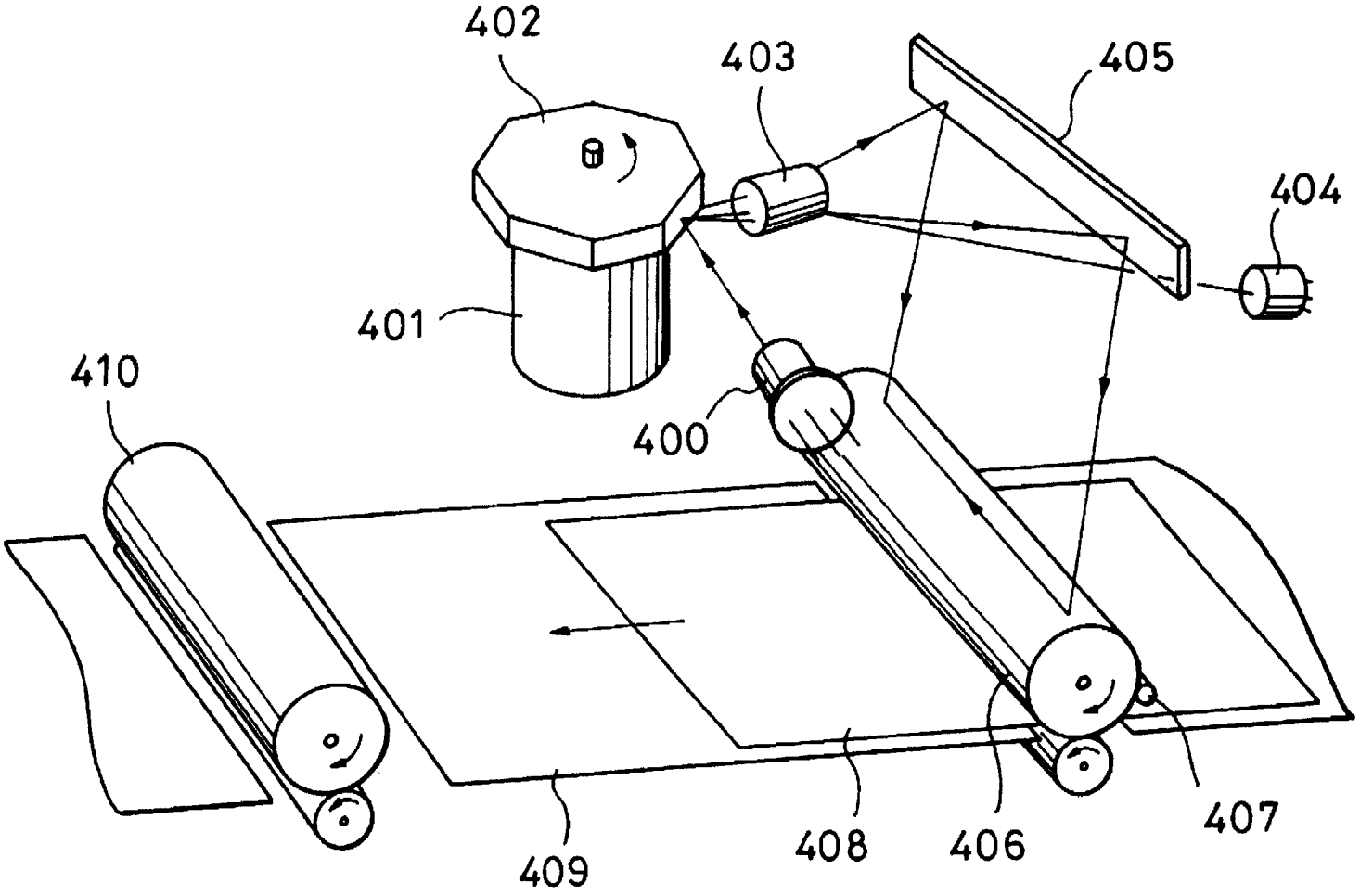
FIG. 5 is a schematic perspective view of the fundamental operation of a laser beam printer.

Referring to FIG. 5, the laser beam printer has a semiconductor laser device 400 for intermittently emitting laser light to image data to be recorded, a polygon mirror motor 401, a polygon mirror 402 rotated by the polygon motor 401, an optical system 403 for imaging, inclination correction and the like, a photodetector 404, a return mirror 405, a photosensitive drum 406, a development device 407, a recording sheet 408, a transport guide 409 and a fixation device 410.

In the thus-constructed laser beam printer, laser light emitted from the semiconductor laser device 400 is deflected by being reflected by the polygon mirror 402, and is led to the surface of the photosensitive drum 406 via the optical system 403 and the return mirror 405 (main scanning). At this time, indexing is performed with the photodetector 404 to determine an irradiation position. In a cycle of this main scanning for one line, the photosensitive drum 406 is rotated by an amount corresponding to one line (sub scanning). An image formed on the photosensitive drum 406 in this manner is developed by the development device 407 and is transported onto the recording sheet 408. The recording sheet 408 is transported along the transport guide 409, undergoes fixation by the fixation device 410 and is thereafter discharged.

Components relating to sub scanning, i.e., the photosensitive drum 406, the development device 407, the transport guide 409 and the fixation device 410, are driven in synchronization with the sub scanning cycle by the recording motor, a gear, a belt and other components (not shown).

Figure 6:
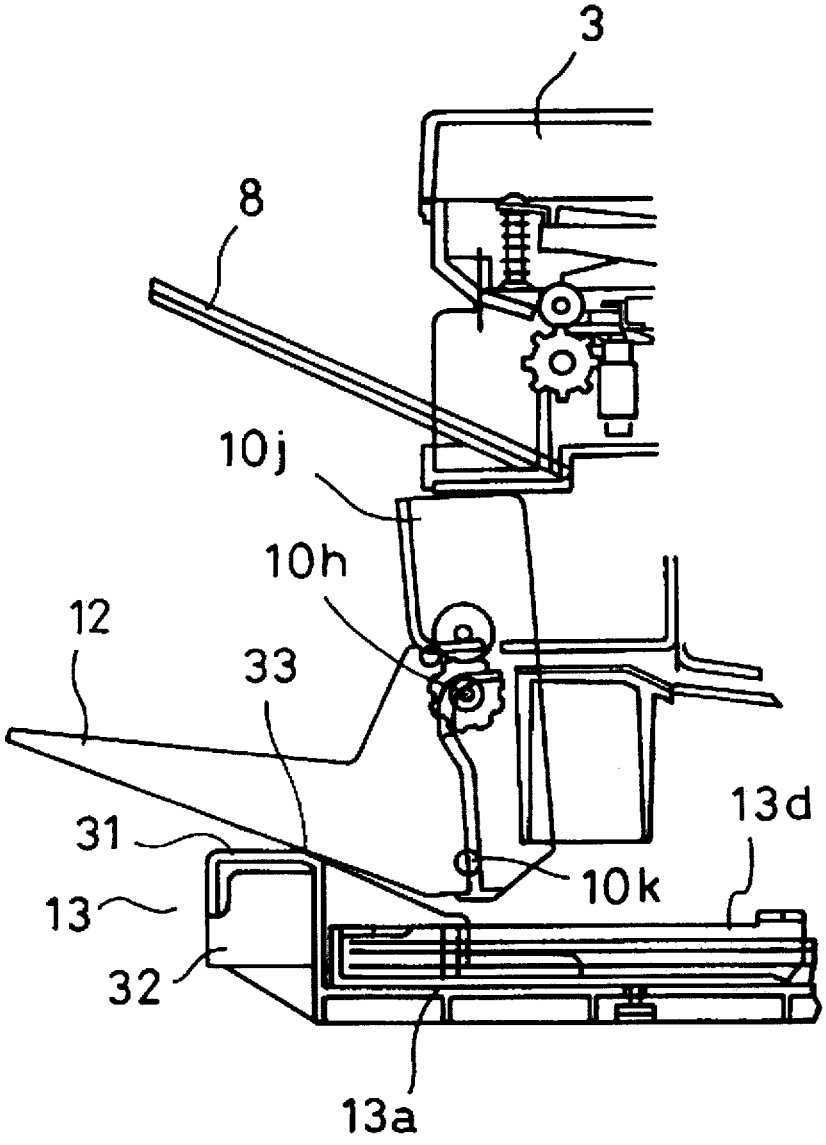
FIG. 6 is a sectional view of the discharge unit of the facsimile machine shown in FIG. 1.

Details of the MP cassette unit 13 will be described below with reference to FIG. 6. The paper discharge cover **10*j* can open by pivotal movement on hinge portion 10*k*. To open the paper discharge cover 10*j*, a lock (not shown) which retains the cover is unlocked by operating a release button 35. In the MP cassette 13*a*, the MP limit plate 13*d* is set for legal size paper in the case illustrated in FIG. 6. Since the legal size paper is larger than the A4 size, the trailing end of the cassette 13*a* protrudes beyond the side surface of the recording apparatus body 1**.

The MP cassette unit 13 has a projecting portion 31 for accommodating the MP cassette **13*a* including the protruding end of the same. The projecting portion 31 is elevated so that its upper portion is in the vicinity of a lower surface of the recording sheet discharge tray 12 when the paper discharge cover 10*j* is closed, as shown in FIG. 1. The distance between the projecting portion 31 and the recording sheet discharge tray 12 is about 3 mm. The arrangement is such that the projecting portion 31 and the recording sheet discharge tray 12 do not contact each other when the MP cassette 13*a* is loaded. The projecting portion 31 is recessed on the reverse side to form a catch 32. The catch 32 can have a sufficiently large height without increasing the height of the MP cassette 13*a*, since the height of the projecting portion 31 is increased along the lower surface of the recording sheet discharge tray 12. Therefore, the handling of the cassette unit is not made more difficult, even though the cassette 13*a*** has a reduced thickness.

The height of the portion of the MP cassette **13*a* accommodated in the recording apparatus body 1 is about 20 mm, while the height of the projecting portion 31 is about 35 mm. If the paper discharge cover 10*j* is opened while the recording sheet discharge tray 12 is set, the projecting portion 31 contacts the lower surface of the recording sheet discharge tray 12 at contact portion 33 to limit the pivotal movement of the cover 10*j*. The operator is thereby reminded to remove the recording sheet discharge tray 12. At the limited position, the paper discharge cover 10*j* is tilted at a rotational angle of about 5°. At this angle, the state of the recording sheet discharge tray 12 in which the loading surface rises toward its outer end is maintained, so that there is no risk of recording sheets S already placed on the recording sheet discharge tray 12 from falling, even if the operator inadvertently moves the paper discharge cover 10*j*** in the opening direction.

Figure 7:
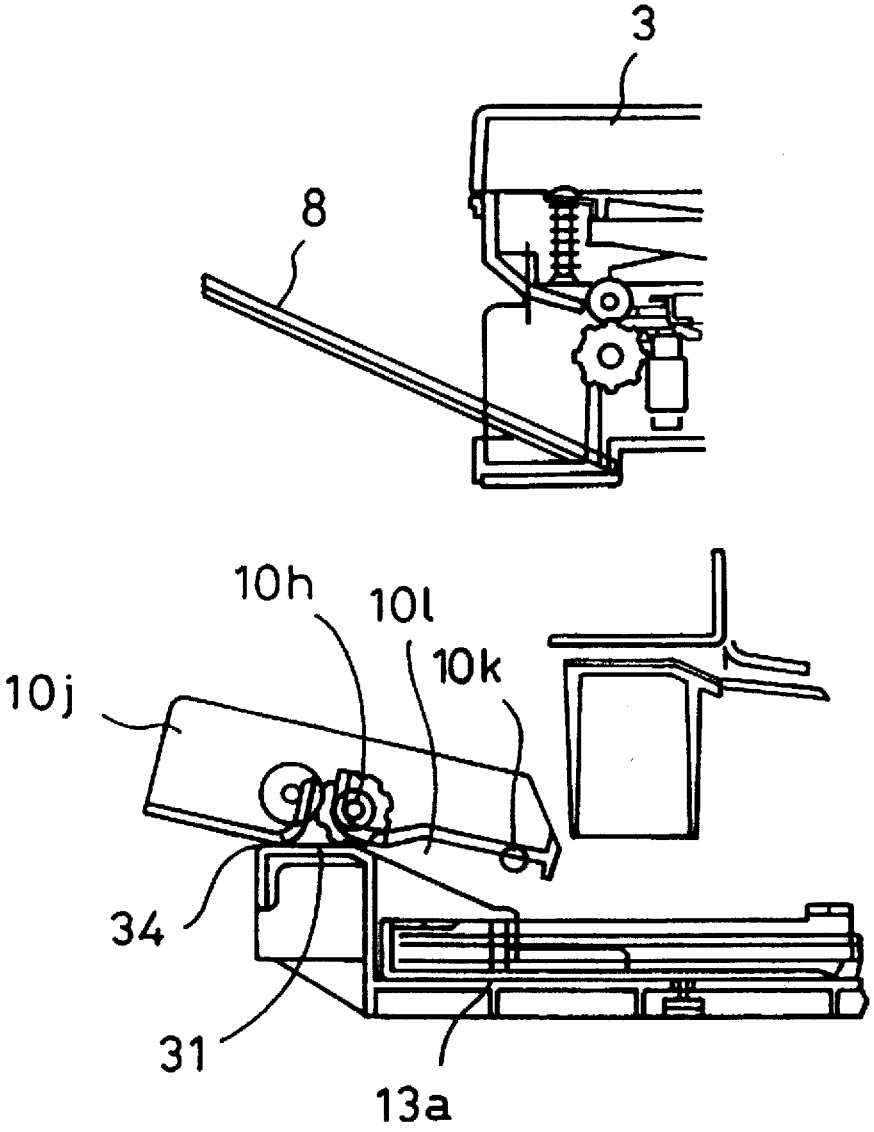
FIG. 7 illustrates removal of a paper discharge cover with the recording sheet discharge tray removed from the machine.

Next, a case where the paper discharge cover **10*j* is opened while the recording sheet discharge tray 12 is removed will be described with reference to FIG. 7**.

If the paper discharge cover **10*j* is opened when the recording sheet discharge tray 12 is removed, the projecting portion 31 contacts the paper discharge cover 10*j* by a contact portion 34 while entering a recessed portion 101 of the paper discharge cover 10*j* since the width of the recessed portion 101 is larger than the width of the projecting portion 31. Therefore, the paper discharge cover 10*j* can be opened by being rotated through about 80° to such a position as to avoid an obstruction to the jam removing operation, even though the projecting portion 31** has a high position.

Figure 8:
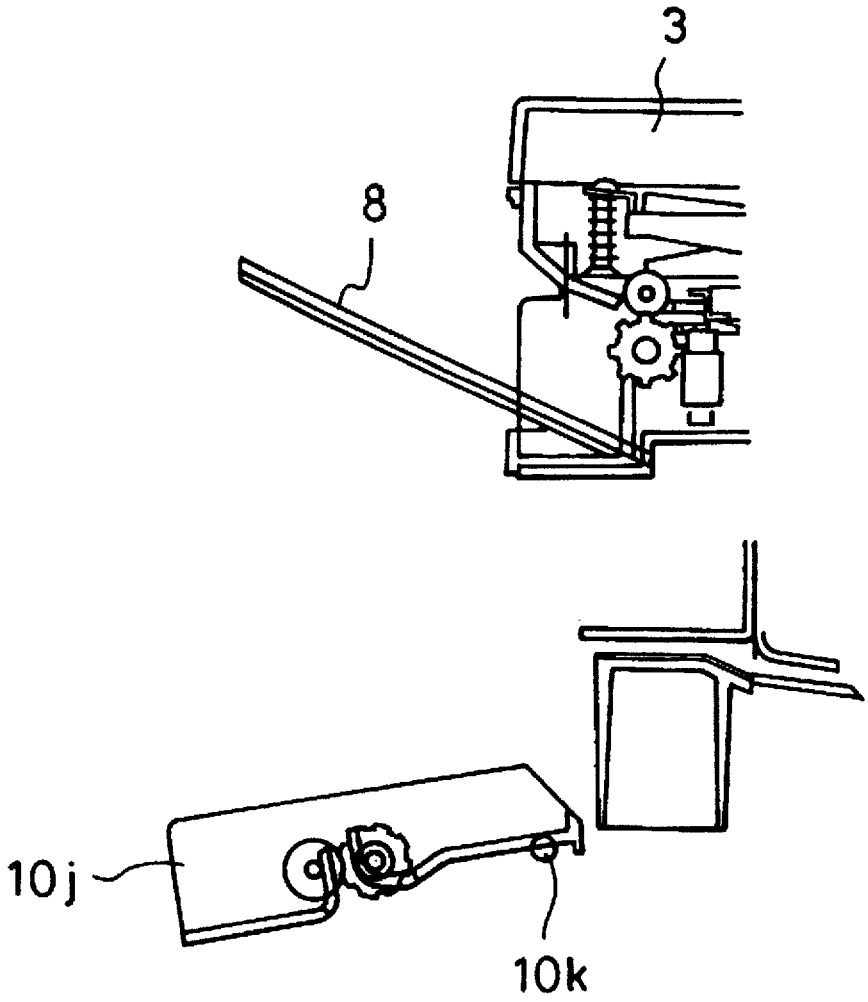
FIG. 8 illustrates removal of a paper discharge cover with a multiple paper cassette removed from the machine.
Figure 9:
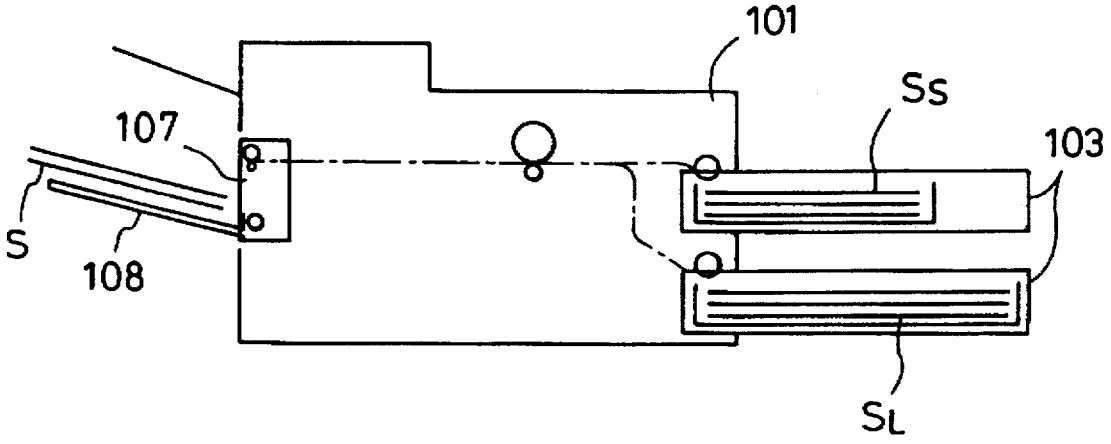
FIG. 9 PRIOR ART
FIG. 9 is a schematic longitudinal sectional view of a conventional image recording apparatus in which a feed cassette is inserted in a direction through a lateral face.
Figure 10:
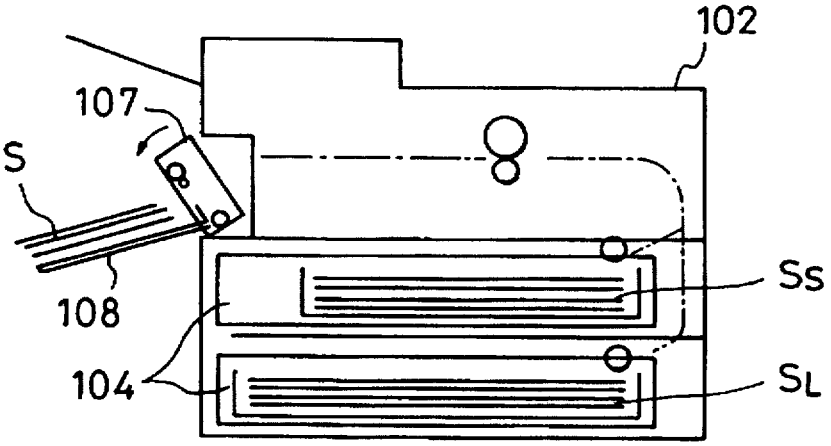
FIG. 10 PRIOR ART
FIG. 10 is a schematic longitudinal sectional view of a conventional image recording apparatus in which feed cassettes are inserted in a direction through a front face.

Next, a case where the paper discharge cover **10*j* is opened while the recording sheet discharge tray 12 and the MP cassette 13*a* are removed will be described with reference to FIG. 8**.

If the paper discharge cover **10*j* is opened in a state where the recording sheet discharge tray 12 and the MP cassette 13*a* are removed, the paper discharge cover 10*j* can be fully rotated to the extent allowed by hinge 10*k* since there is no member capable of contacting the cover 10*j*. The illustrated angle through which the paper discharge cover 10*j* is rotated is about 100°, thus exceeding 90°. Thus, the opening construction can be adapted for a case where it is desirable to further open the paper discharge cover 10*j* and where the jam removing operation, the operation for maintenance of the fixation device 10*g***, or the like is to be performed.

The MP cassette unit 13, the cassette feeder unit 11 and the second-stage cassette feeder unit 27 will be described in comparison with each other.

As mentioned above, the MP cassette unit 13 is of the side loading type, recording sheets having A4, letter and legal sizes can be set in the cassette of this unit, and the maximum number of recording sheets containable in the cassette is about 100. The cassette feeder unit 11 and the second-stage cassette feeder unit 27 are of the front loading type. In each of the cassette feeder unit 11 and the second-stage cassette feeder unit 27, recording sheets having A4 and letter sizes can be set in the cassette and the maximum number of recording sheets containable in the cassette is about 500.

In the case of the front loading system, cassette guides 11*j* and 11*k* for guiding the feed cassette 11*a* are required. Therefore, if recording sheets have a longer length, the distance between the cassette guides 11*j* and 11*k* must be increased, resulting in an increase in the overall width of the cassette feeder unit 11.

In the case of the side loading system, even if the recording sheet length is increased, only the amount of projection out of the recording apparatus body 1 is changed with respect to the length of the MP cassette 13*a*, and no change is caused with respect to the width of the recording apparatus body 1. The cassette inserting direction is set opposite to the direction of discharge of recording sheets S to enable the projecting portion 31 to be disposed under the recording sheet discharge tray 12, thereby avoiding any increase in installation area. Also, the width of the projecting portion 31 is selected so that it is smaller than the width of the recording sheet discharge tray 12 and the projecting portion 31 is formed so that its height increases along the lower surface of the recording sheet discharge tray 12. Therefore, dust or the like cannot easily enter the internal space of the MP cassette 13*a* and there is no need to attach a dust-proof cover to the MP cassette 13*a*.

Thus, the size of the recording apparatus can be reduced without reducing the number of containable recording sheet sizes. Further, the MP cassette unit 13 of the side loading type is provided on the uppermost stage to maintain the number of containable recording sheet sizes even if the cassette feeder unit 11 and the second-stage cassette feeder unit 27 are not attached.

The separation method will next be described.

The friction separation method, e.g., the frictional member separation method used in the MP separation unit 30 shown in FIG. 1, is advantageous in that the number of types of recording sheets S to which the method can be adapted is comparatively large. For example, overhead projector sheets, to which the ordinary claw separation method used for the cassette feeder unit 11 and the second-stage cassette feeder unit 27 cannot be adapted, can be fed by the friction separation method. The friction separation method, however, entails problems in that the separation mechanism is liable to be complicated in comparison with the mechanism used for the claw separation method, and that a change in performance can easily result from wear of the MP separation roller 30*a* and the MP separation pad 30*b*.

According to the present invention, therefore, the friction separation method is adopted for the MP separation unit 30 in which the number of different containable recording sheet sizes is larger while the maximum number of containable recording sheets is smaller, and the claw separation method is adopted for the cassette feeder unit 11 and the second-stage cassette feeder unit 27 in which the number of different containable recording sheet sizes is smaller while the maximum number of containable recording sheets is larger. In this arrangement, various types of recording sheets S can be fed even if the cassette feeder unit 11 and the second-stage cassette feeder unit 27 are not attached, and the cassette feeder unit 11 and the second-stage cassette feeder unit 27 may be attached for large quantity paper feeding because they have improved durability. Since in the case of the front loading system, recording sheets S can be resupplied without removing the cassettes 11*a* and 27*a*, it is not an undue burden to resupply a large number of recording sheets S. Further, since the maximum number of recording sheets containable in the MP cassette 13*a* is small, the MP cassette 13*a* is light and can easily be detached from the recording apparatus body 1.

The MP separation roller 30*a* of the MP separation unit 30 and the feed rollers 11*b* and that of the cassette feeder unit 11 and the second-stage cassette feeder unit 27, respectively are disposed collectively at one side of the recording apparatus body 1 opposite to the recording sheet S discharge side, thereby enabling systems for driving the rollers to be arranged collectively. Also, paper paths from the cassette feeder unit 11 and the second-stage cassette feeder unit 27 can be arranged to extend vertically adjacent the inserted end of the MP cassette 13*a*. It is therefore possible to feed paper from the cassette feeder unit 11 and the second-stage cassette feeder unit 27 irrespective of whether or not the MP cassette 13*a* has been inserted in the body of the facsimile machine.

Also, a jam of recording sheets, which occurs easily at the separation section, can be removed easily by opening the right cover 28 and the jam removal cover 11*i*.

In the above-described embodiment, the recording apparatus uses three recording sheet sizes, i.e., A4, letter and legal sizes. Needless to say, the present invention can also be applied to a sheet feeding system using sheets having four or more sizes, including the A3 size.

The image recording unit was described as a laser beam printer. However, the present invention can be applied to any other recording apparatuses of an electrophotography type, a thermal transfer type, an ink jet type and the like, as long as cut sheets are used for recording.

The number of paper feeder units, the type of recording sheets used and the number of sheets contained in each cassette are not particularly limited as long as they do not depart from the basic arrangement of the invention.

As described above, the MP cassette containing recording sheets not frequently used and having, for example, a larger size, can be arranged to be inserted into the image recording apparatus in a direction through a side portion of the apparatus, while each feed cassette containing recording sheets frequently used and having a smaller size can be arranged to be inserted into the image recording apparatus in a direction through a front portion of the apparatus. The need for increasing the size of all cassettes to contain large recording sheets not frequently used is therefore eliminated and the size of the recording apparatus can be reduced.

Further, each feed cassette inserted in a direction through a front portion of the apparatus body is formed so as to have a larger capacity to contain recording sheets having an ordinary or smaller size and thus frequently used, while the MP cassette inserted through a side portion is formed so as to have a smaller capacity and to contain recording sheets having a larger size and not frequently used. Thus, the inefficient use of cassettes that allows recording sheets not frequently used and having a larger size to unnecessarily occupy a large-capacity cassette can be avoided, and recording sheets can be efficiently contained.

Further, an opening through which the MP cassette is inserted is formed under a paper discharge port through which each recording sheet is discharged after recording, and a paper discharge tray is provided on which recording sheets discharged after recording are placed with their leading ends maintained at a higher position. The height of a portion of the MP cassette projecting from a side surface of the recording apparatus body is increased along a lower surface of the paper discharge tray. Therefore, even when the paper discharge tray is attached to the paper discharge cover, the paper discharge cover is prevented from being inadvertently opened while recording sheets are placed on the paper discharge tray, thereby preventing the recording sheets on the tray from falling.

Next will be described a means for informing an operator of a condition where no sheets remain in the feed cassette.

In general, apparatuses having feed cassettes are provided with a sheet sensor for detecting the existence or non-existence of recording sheets contained in each feed cassette. When recording sheets are entirely gone out of each cassette, the control unit receiving a signal from the sensor determines that there is no recording sheet in the feed cassette and causes to operate a warning indication on the display unit. The operator confirms the warning, draws the feed cassette out of the recording apparatus body, sets recording sheets in the cassette and reloads the cassette in the apparatus body.

A paper-out warning means will now be described with reference to the drawings. The same means are respectively provided for the feed cassettes 11*a* and 27*a*. Therefore, only a warning display means provided on the feed cassette 11*a* will be described.

Figure 11:
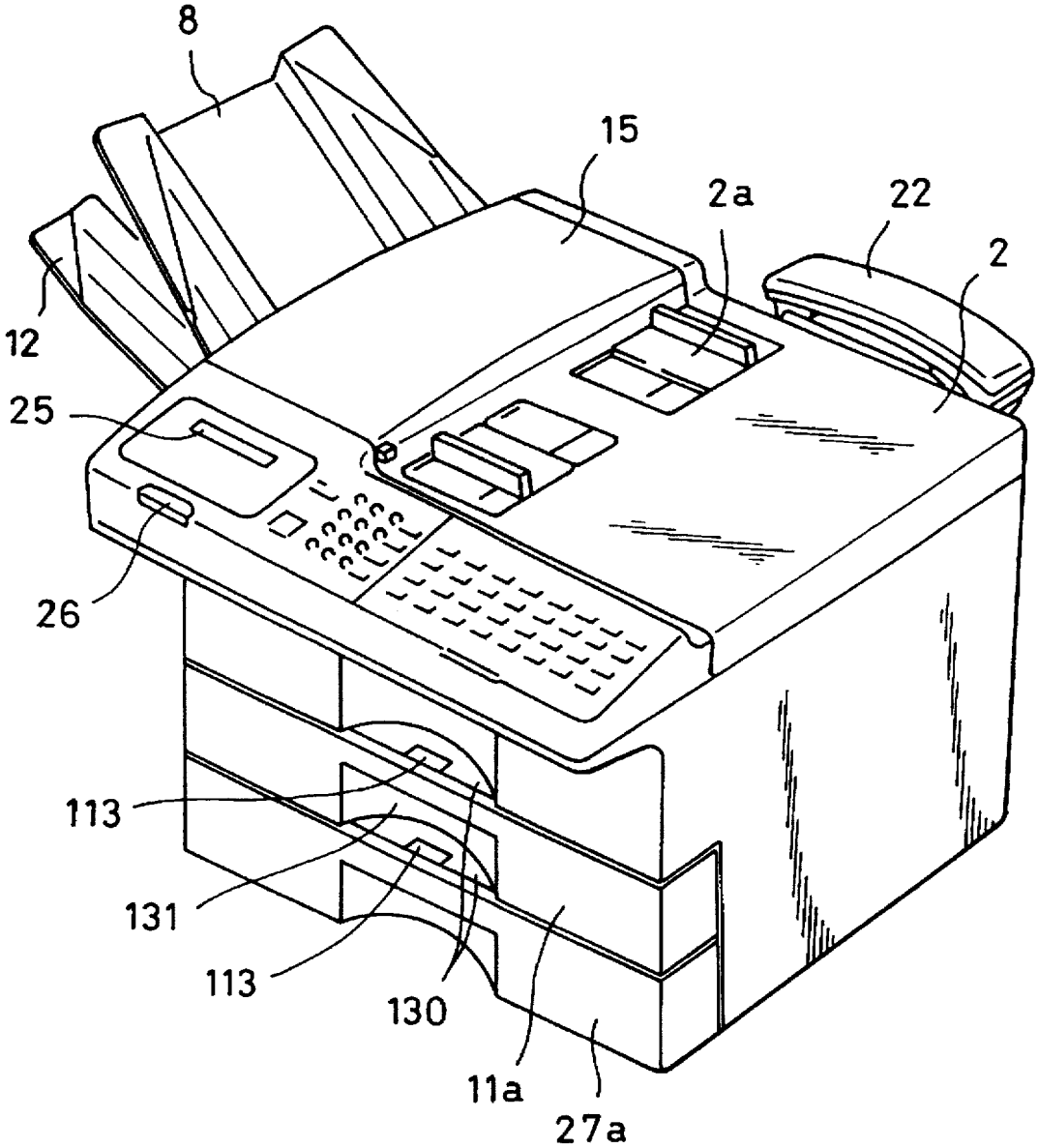
FIG. 11 is a perspective view of a facsimile machine having a display portion to indicate when there are no sheets in the feed cassette.
Figure 12:
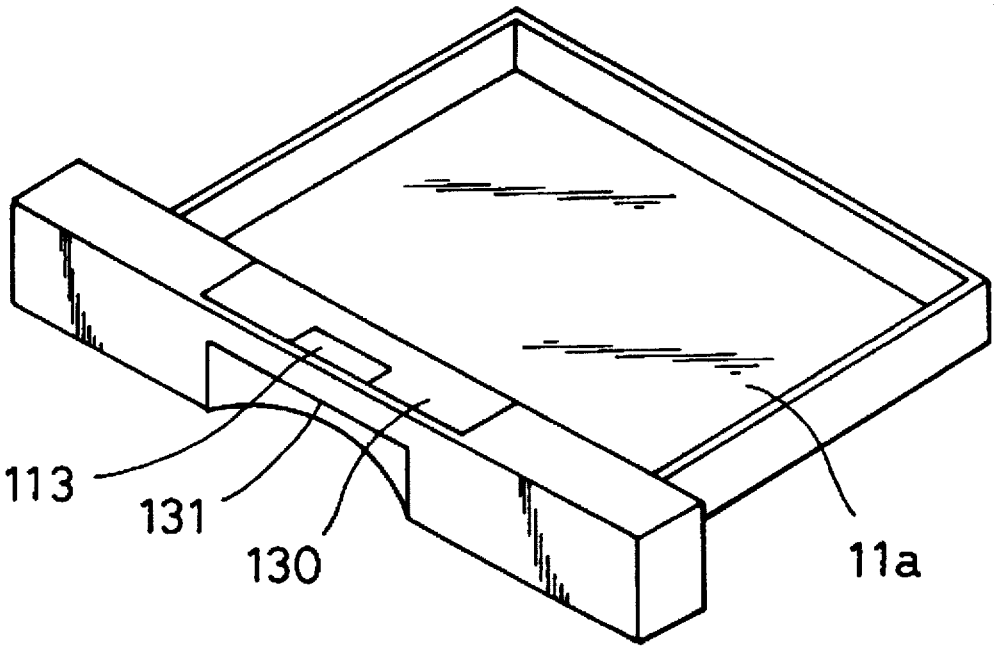
FIG. 12 is a perspective view of the feed cassette in the facsimile machine shown in FIG. 11.
Figure 13:
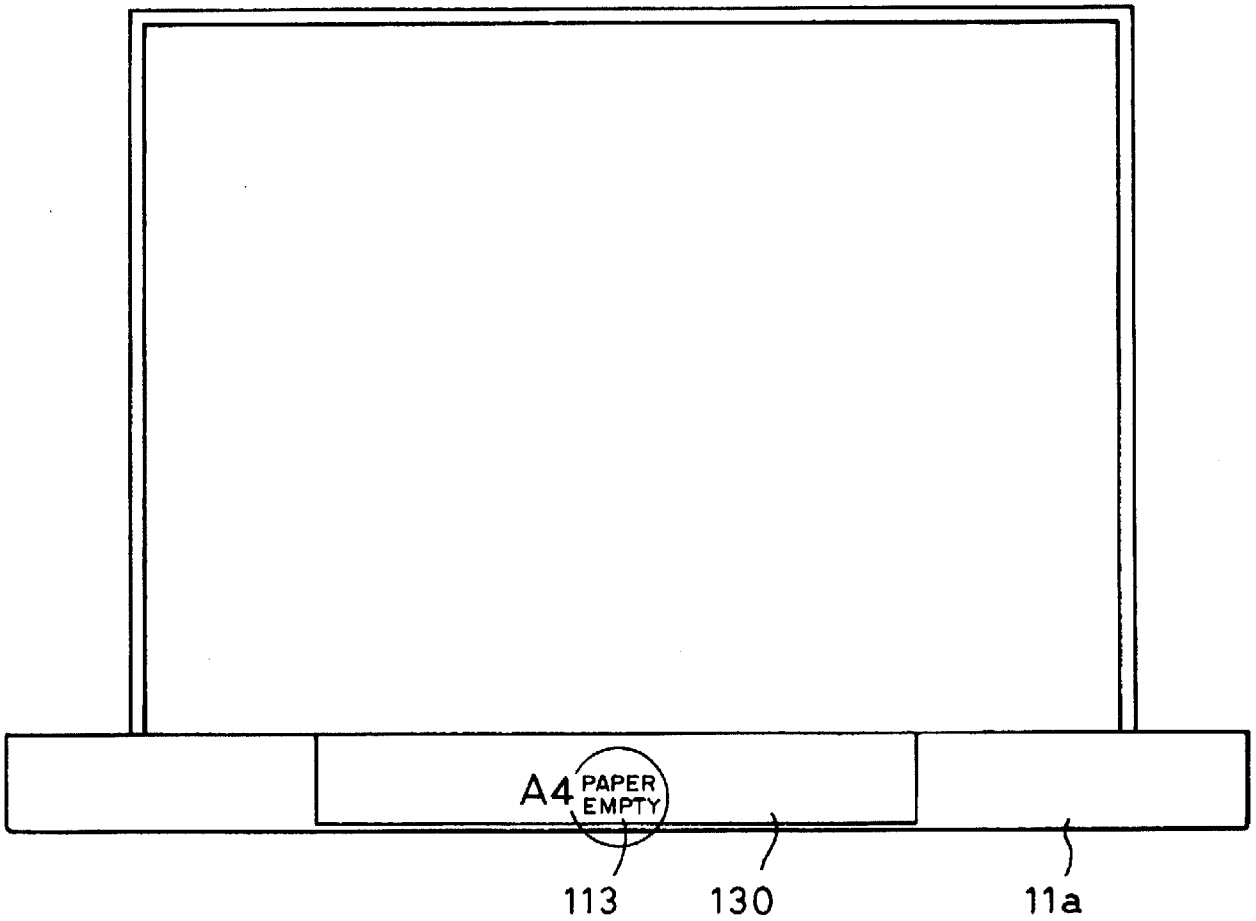
FIG. 13 is a plan view of the feed cassette shown in FIG. 12.
Figure 14:
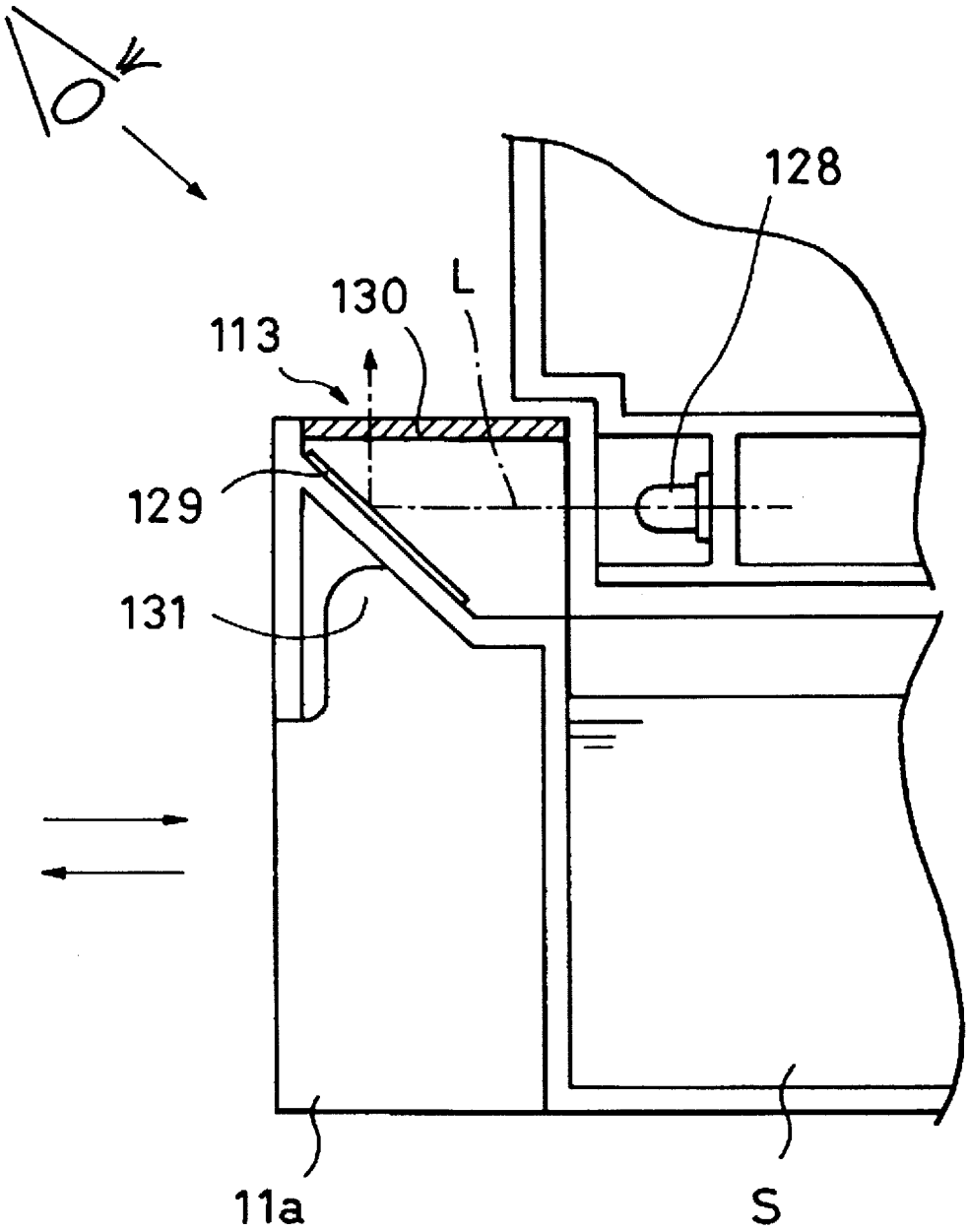
FIG. 14 is a longitudinal sectional view of the display portion of the facsimile machine of FIG. 11.

As shown in FIGS. 11 and 12, the feed cassette 11*a* has a circular-arc recess under a catch portion 131 in which fingers of a user are inserted when the cassette 11*a* is inserted into or drawn out of the apparatus body, and the catch portion 131 is formed so as to be easily caught by the fingers, as shown in FIG 14.

A display member 130 on which a cassette size display (indicating A4 or the like) and a paper-out warning display ("PAPER EMPTY" or the like) is bonded to an upper portion of the feed cassette 11*a* above the catch portion 131. The paper-out warning sentence is represented by highlighted characters formed by a light transmitting material. A lower surface of the display member 130 is processed by granulation coating or the like so as to be capable of diffusing light so that characters are uniformly lighted when the lower surface is irradiated with light.

A portion of the feed cassette 11*a* under a lighting display portion 113 is slanted at a 45° angle as shown in FIG. 14 and a reflecting plate 129 is provided on this slanted portion. A light emitting diode (LED) 128 is provided in the apparatus body so as to face the reflecting plate 129. When the feed cassette 11*a* is inserted into the apparatus body, an optical path L is formed as shown in FIG. 14 to enable the characters on the display member 130 to emerge from the background by the effect of light reflected by the reflecting plate 129.

The operation of this display means will be described below.

When the feed cassette 11*a* is containing recording sheets S, a signal indicating that there are some sheets is sent from a sensor (not shown) for detecting the existence or non-existence of sheets to the CPU 301. The sheet existence/non-existence sensor may be a lever type sensor, photoelectric type sensor or any other sensors ordinarily used. When feed cassette 11*a* contains sheets, the LED 128 is not illuminated and the characters "PAPER EMPTY" on the lighting display portion 113 are not illuminated enough to be recognized by the user's eye.

When no recording sheets S remain in the feed cassette 11*a* as a result of feeding of recording sheets S from the cassette into the recording apparatus, a signal indicating that there are no sheets is sent from the sheet existence/non-existence sensor to the CPU 301. At this time, the LED 128 is illuminated so that the characters "PAPER EMPTY" emerge on the lighting display portion 113, thereby enabling the user to easily recognize that feed cassette 11*a* contains no recording sheets S.

When the user draws the feed cassette 11*a* containing no recording sheets S out of the apparatus body, a signal indicating that no cassette is loaded is sent from a sensor for detecting the feed cassette loading to the CPU 301. At this time, the lighting of the LED 128 is turned off to prevent occurrence of a situation where the LED 128 continues lighting from the apparatus body from which the cassette 11*a* is drawn out.

When the user inserts the feed cassette 11*a* in the apparatus body after filling the same with recording sheets S, the LED 128 is maintained in the turned-off state. If the feed cassette 11*a* is inserted into the apparatus body without being filled with recording sheets S, the LED 128 is lighted again to attract user's attention.

This process will be described with reference to a flowchart of FIG. 17. When the power switch is turned on (in step ST0), the sensor (not shown) operates in step ST1 to determine whether the feed cassette 11*a* has been inserted in the apparatus body. If it is thereby determined that the cassette 11*a* is not inserted, a display is made on the display portion of the apparatus body to indicate the non-existence of the feed cassette 11*a* in step ST2. In step ST3, the sensor also operates to determine whether the feed cassette 11*a* has been inserted.

If it is determined in step 2 or 3 that the feed cassette 11*a* has been inserted in the apparatus body, the sheet existence/non-existence sensor (not shown) operates in step ST4 to determine whether some recording sheets are contained in the feed cassette 11*a*. If it is determined that recording sheets are contained, the process advances to step ST5 to make a standby display.

If it is determined in step ST4 that there are no recording sheets in the feed cassette 11*a*, a display is made in step ST6 on the display portion of the apparatus body to indicate that there are no recording sheets. Further, in step ST7, the LED 128 is illuminated to highlight characters "PAPER EMPTY" on the lighting display portion 113.

Next, in step ST8, a detection is made as to whether the feed cassette 11*a* has been drawn out to be refilled with recording sheets. In the case where the feed cassette 11*a* is inserted, the process returns to step ST6 to continue the display indicating that there are no recording sheets. If it is determined in step ST8 that the feed cassette 11*a* has been drawn out, the LED 128 is turned off to stop the no-recording sheet display in step ST9. If insertion of the feed cassette 11*a* is detected in step ST10, the sheet existence/non-existence sensor operates again in step ST11 to determine whether recording sheets are contained in the feed cassette 11*a*. If the feed cassette 11*a* has not been refilled, the process returns to step ST7 to again illuminate the LED 128 for no-recording sheet display. If it is determined in step ST11 that recording sheets are contained in the feed cassette 11*a*, the process advances to step ST12 to make a standby display. Thus, the feed cassette existence/non-existence display and the display for indicating the existence or non-existence of recording sheets in the feed cassette are effected.

In this embodiment, highlighted characters "PAPER EMPTY" are displayed on the display portion. However, a graphic symbol or other types of display may alternatively be used.

The reflecting plate 129 is not always necessary. The same display effect may be achieved by setting the display surface at such an angle that displayed characters or the like can easily be recognized by the user.

Figure 15:
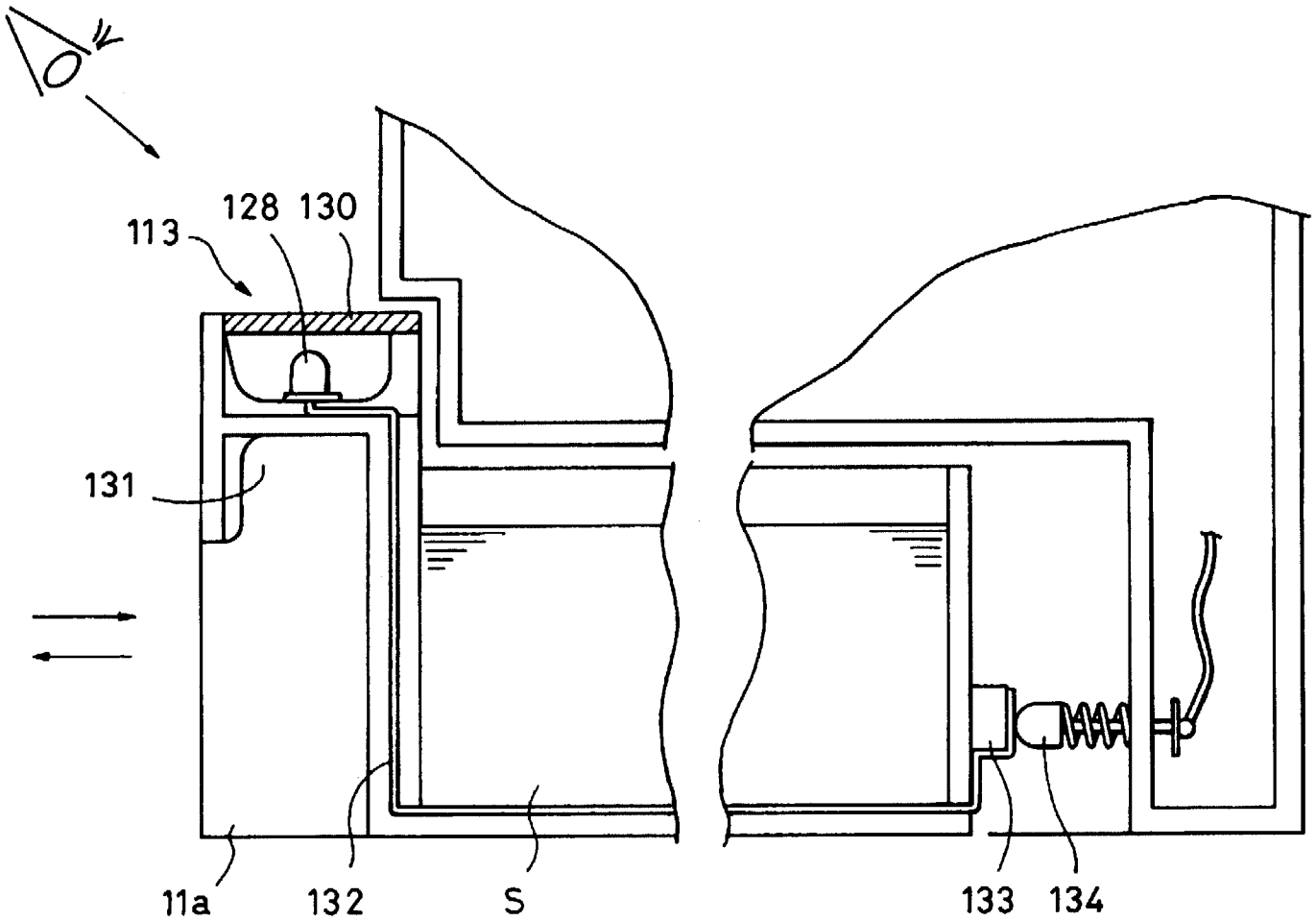
FIG. 15 is a longitudinal sectional view of another example of a display portion.
Figure 16:
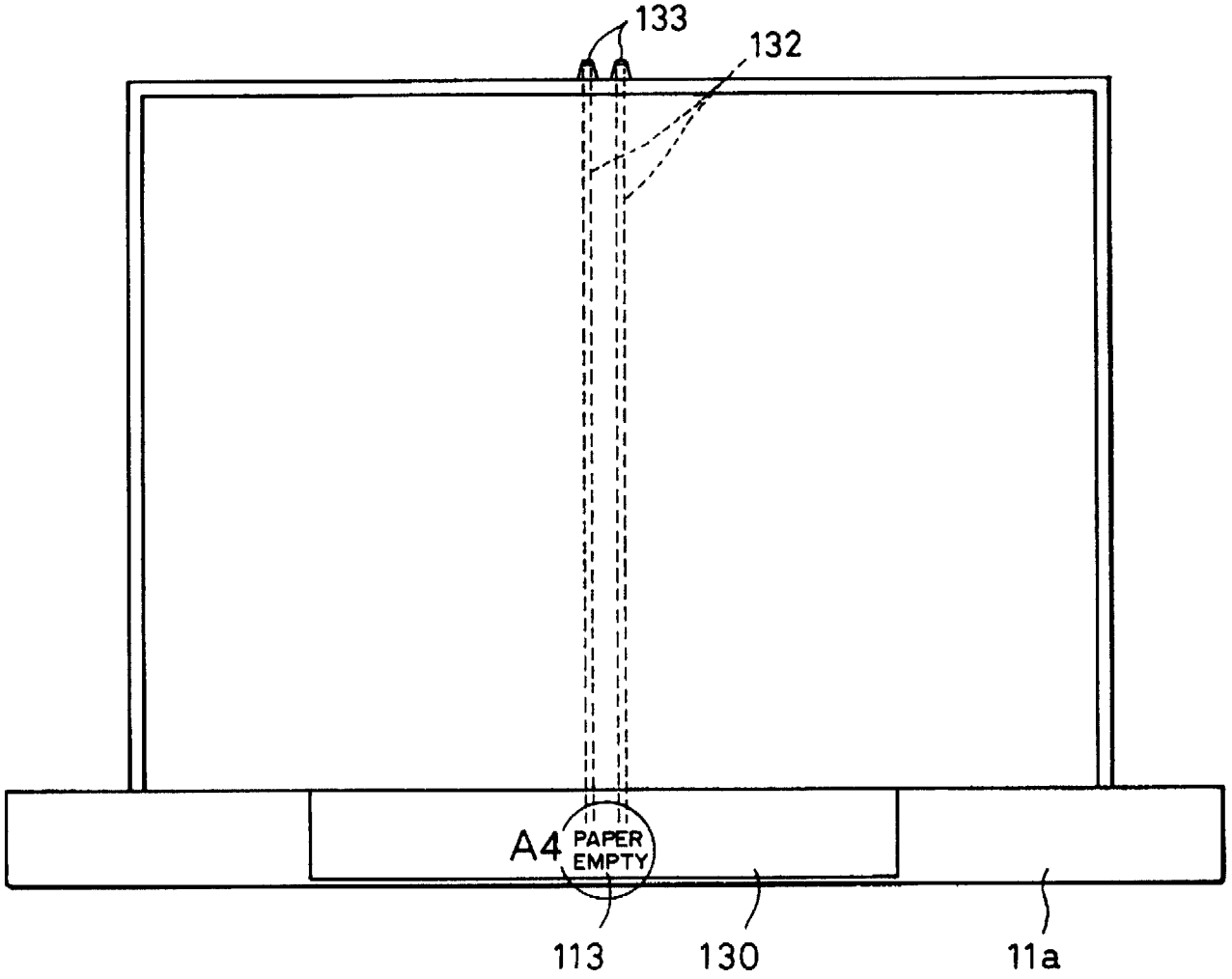
FIG. 16 is a plan view of the feed cassette shown in FIG. 15.

Another example of the warning display means having a light emitting portion on the feed cassette 11*a* side is illustrated in FIGS. 15 and 16. FIG. 15 is a cross-sectional view of the light emitting portion, and FIG. 16 is a plan view of the feed cassette 11*a*.

As shown in FIG. 15, an LED 128 is provided under a display member 130 of a lighting display portion 113 for displaying a paper-out warning. A paper-out warning sentence is represented by highlighted characters, and the characters emerge from the background when the LED 128 is illuminated, as in the case of the above-described example.

Conductors 132 from the LED 128 are connected to contacts 133 provided on a portion of the feed cassette 11*a* opposite to the catch portion, as shown in FIG. 16. When the feed cassette 11*a* is fully inserted in the apparatus body, the contacts 133 are brought into contact with and electrically connected to other contacts 134 provided on the apparatus body in corresponding positions (FIG. 15), thereby closing the electric circuit.

In this arrangement, when the user draws the feed cassette 11*a* out of the apparatus body to refill it with recording sheets S, the contacts are disconnected and the LED 128 is turned off.

Figure 18:
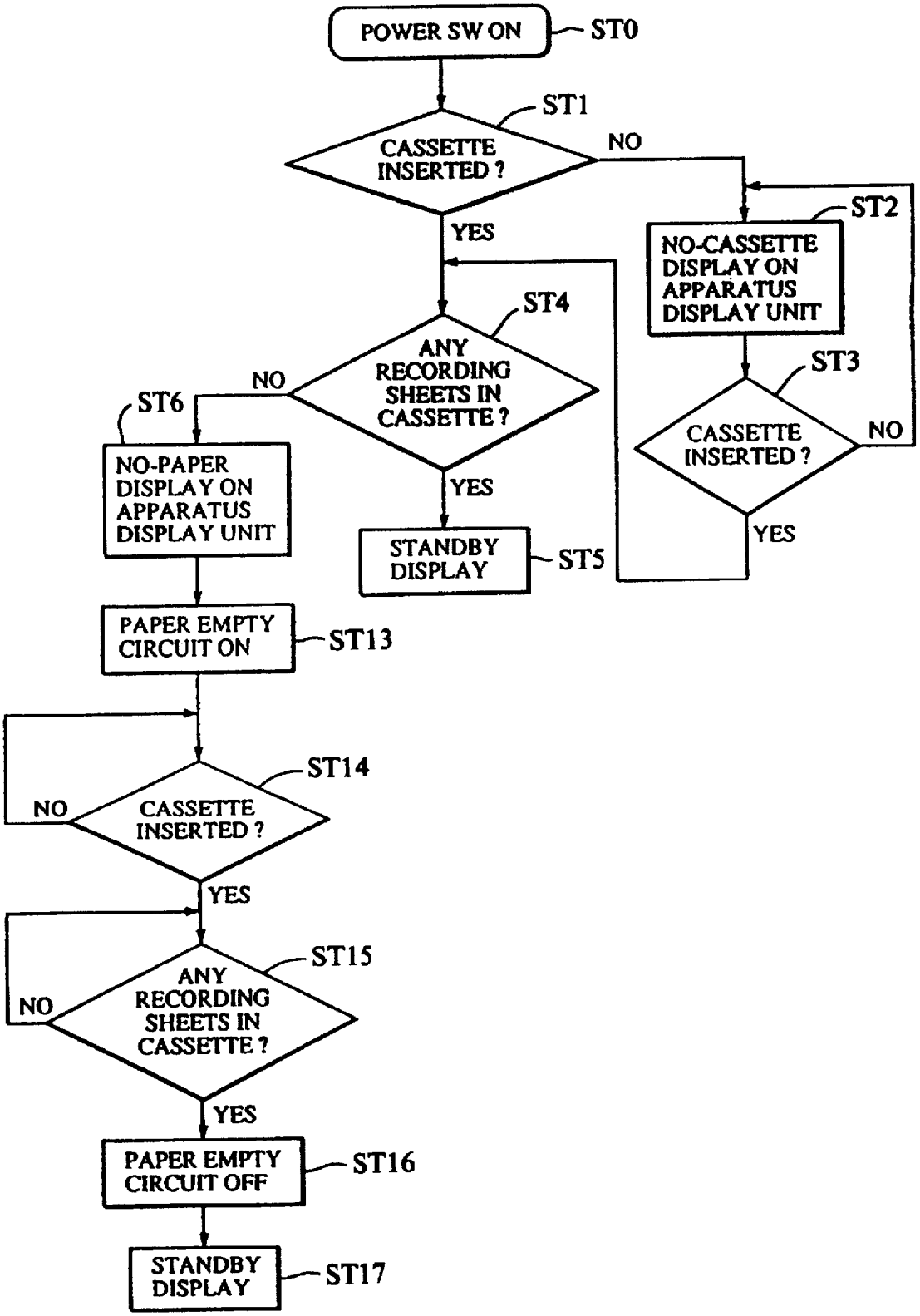
FIG. 18 is a flowchart of another process of controlling the display.

FIG. 18 shows a flowchart of this operation. Steps ST1 to ST6 of this flowchart are the same as those of the flowchart shown in FIG. 17. Only different steps will therefore be described. In step ST6, a display is made on the display portion of the apparatus body to indicate that there are no recording sheets. Then, in step ST13, the electric circuit (not shown) for supplying electric current to the LED 128 is turned on, whereby a current flows from the apparatus body to the LED 128 through the contacts 133 and 134 to illuminate the LED 128, thereby highlighting the characters "PAPER EMPTY".

Subsequently, a detection is made in step ST14 as to whether the user has drawn out the feed cassette 11*a* to refill the same with recording sheets and has again inserted the cassette in the apparatus body. If the feed cassette 11*a* has been inserted, a detection is made in step ST15 as to whether sheets are contained in the feed cassette 11*a*. If it is determined in step ST15 that recording sheets are contained, the electric circuit is turned off to stop illuminating the LED 128 in step ST16, and the process advances to step ST17 to make a standby display.

As described above in detail, when there are no sheets, an illuminated display is actuated on a front horizontal surface of the feed cassette to ensure that the user can recognize the state of the cassette having no sheets. Thus, an image recording apparatus improved in handling can be provided.

Further, a drawing-out detection means is provided to stop illumination of the display when the feed cassette is drawn out. Unnecessary lighting of the display and wasteful power consumption are prevented by this means.

While the present invention has been described with respect to what presently are considered to be preferred embodiments, it is to be understood that the invention is not limited to the disclosed embodiments. To the contrary, the present invention is intended to cover various modifications and equivalent arrangements included within the spirit and scope of the appended claims.

What is claimed is:

1. A sheet feeding apparatus for supplying sheets to an image recording device, comprising:

first sheet supporting means for supporting manually-stacked sheets, said sheets to be supplied to the image recording device, said first sheet supporting means being mountable to the image recording device so as to be insertable into and drawable from a side of the image recording device opposite to a side of the image recording device at which is disposed a feeding roller for feeding sheets from said first sheet supporting means; and second sheet supporting means for supporting manually-stacked sheets, said sheets to be supplied to the image recording device, said second sheet supporting means being mountable to the image recording device so as to be insertable into and drawable from the image recording device in a direction orthogonal to the inserting and drawing out direction of said first sheet supporting means, and at a different elevation from said first sheet supporting means.

2. A sheet feeding apparatus according to claim 1, wherein said first sheet supporting means is mountable to the image recording device so that it is insertable in and drawable out of the image recording device through a side portion of the image recording device, while said second sheet supporting means is mountable to the image recording device so that it is insertable in and drawable out of a front portion of the image recording device.

3. A sheet feeding apparatus according to claim 1, wherein said first sheet supporting means supports sheets larger than a maximum size sheet supported by said second sheet supporting means.

4. An image recording apparatus comprising:

a sheet feeding apparatus for supplying sheets to an image recording device, said sheet feeding apparatus comprising (a) first sheet supporting means for supporting manually-stacked sheets, said sheets to be supplied to the image recording device, said first sheet supporting means being mountable to the image recording device so as to be insertable into and drawable from a side of the image recording device opposite to a side of the image recording device at which is disposed a feeding roller for feeding sheets from said first sheet supporting means, and (b) second sheet supporting means for supporting manually-stacked sheets, said sheets to be supplied to the image recording device, said second sheet supporting means being mountable to the image recording device so as to be insertable in and drawable from the image recording device in a direction orthogonal to the inserting and drawing out direction of said first sheet supporting means, and at a different elevation from said first sheet supporting means;

transport means for transporting sheets fed out of said sheet feeding apparatus; and image recording means for recording an image on each sheet transported by said transport means.

5. An image recording apparatus according to claim 4, wherein said first sheet supporting means is mountable to the image recording device so that it is inserted in and drawn out of the image recording device through a side portion of the image recording device, while said second sheet supporting means is mountable to the image recording device so that it is inserted in and drawn out of a front portion of the image recording device.

6. An image recording apparatus according to claim 4, wherein said first sheet supporting means supports sheets larger than a maximum size sheet supported by said second sheet supporting means.

7. A sheet feeding apparatus for supplying sheets to an image recording device, comprising:

first sheet supporting means for supporting manually-stacked sheets, said sheets to be supplied to the image recording device, said first sheet supporting means being mountable to the image recording device so as to be insertable in and drawable from a first side of the image recording device;

sheet feeding means for feeding sheets supported on said first sheet supporting means in a mounting direction of said first sheet supporting means, said sheet feeding means being disposed at a vicinity of a second side of the image recording device opposite to the first side of the image recording device; and second sheet supporting means for supporting manually-stacked sheets, said second sheet supporting means being mountable to the image recording device so as to be insertable in and drawable from a third side of the image recording device in a direction orthogonal to a direction of mounting and drawing out of said first sheet supporting means, and at a different elevation from said first sheet supporting means.

8. A sheet feeding apparatus according to claim 7, wherein said first sheet supporting means is mountable to the image recording device so that it is drawn out of the image recording device through a side portion of the image recording device, while said second sheet supporting means is mountable to the image recording device so that it is drawn out through a front portion of the image recording device.

9. A sheet feeding apparatus according to claim 8, wherein said first sheet supporting means will support sheets larger than a maximum size sheet supported by said second sheet supporting means.

10. A sheet feeding apparatus according to claim 7, wherein said first sheet supporting means, when mounted, is positioned between the image recording device and said second sheet supporting means.

11. A sheet feeding apparatus according to claim 7, further comprising discharged sheet supporting means for supporting sheets on which images have been recorded by the image recording device and which are discharged out of the image recording device, said discharged sheet supporting means being provided on a side portion of the image recording device, an opening through which said first sheet supporting means is set in the image recording device being formed below said discharged sheet supporting means.

12. A sheet feeding apparatus according to claim 11, wherein said first sheet supporting means has a portion projecting laterally from a side portion of the apparatus body and a catch portion formed in the projecting portion.

13. A sheet feeding apparatus according to claim 12, wherein the image recording device has a sheet discharge cover swingable to an open position for a jam removing operation, the swinging motion of said discharge cover being limited by the projecting portion of said first sheet supporting means when said first sheet supporting means is mounted in the image recording device.

14. A sheet feeding apparatus according to claim 7, wherein said second sheet supporting means includes an illuminated display portion formed on a front side extending horizontally in the drawing out direction and further includes sheet existence/non-existence detection means for detecting the existence or non-existence of sheets in said second sheet supporting means, said illuminated display portion emitting light on the basis of the detection by said sheet existence/non-existence detection means.

15. A sheet feeding apparatus according to any one of claims 7 to 13, further comprising first and second separation means for separating feeding sheets contained in said first and second sheet supporting means, said first separation means comprising friction separation means including a rotary feeding member and a friction member, and said second separation means comprising a separating claw for stopping an end corner portion of each contained sheet.

16. An image recording apparatus comprising:

a sheet feeding apparatus for supplying sheets to an image recording device, comprising (a) first sheet supporting means for supporting manually-stacked sheets, said sheets to be supplied to the image recording device, said first sheet supporting means being mountable to the image recording device so as to be insertable in and drawable from a first side of the image recording device, (b) sheet feeding means for feeding sheets supported on said first sheet supporting means in a direction of mounting said first sheet supporting means, said sheet feeding means being disposed at a vicinity of a second side of the image recording device opposite to the first side of the image recording device, and (c) second sheet supporting means for supporting manually-stacked sheets, said second sheet supporting means being mountable to the image recording device so as to be drawable from a third side of the image recording device in a direction orthogonal to the inserting and drawing out directions of said first sheet supporting means, and at a different elevation from said first sheet supporting means;

transport means for transporting sheets fed out of said sheet feeding apparatus; and image recording means for recording an image on each sheet transported by said transport means.

17. An image recording apparatus according to claim 16, wherein said first sheet supporting means is mountable to the image recording device so that it is drawn out of the image recording device through a side portion of the image recording device, while said second sheet supporting means is mountable to the image recording device so that it is drawn out through a front portion of the image recording device.

18. An image recording apparatus according to claim 17, wherein said first sheet supporting means will support sheets larger than a maximum size sheet supported by said second sheet supporting means.

19. An image recording apparatus according to claim 16, wherein said first sheet supporting means, when mounted, is positioned between said image recording means and said second sheet supporting means.

20. An image recording apparatus according to claim 19, wherein said first sheet supporting means has a portion projecting laterally from a side portion of the apparatus body and a catch portion formed in the projecting portion.

21. An image recording apparatus according to claim 16, further comprising discharged sheet supporting means for supporting sheets on which images have been recorded by the image recording device and which are discharged out of the image recording device, said discharged sheet supporting means being provided on a side portion of the image recording device, an opening through which said first sheet supporting means is set in the image recording device being formed below said discharged sheet supporting means.

22. An image recording apparatus according to claim 21, wherein the image recording device has a sheet discharge cover swingable to an open position for a jam removing operation, the swinging motion of said discharge cover being limited by the projecting portion of said first sheet supporting means when said first sheet supporting means is mounted in the image recording device.

23. An image recording apparatus according to claim 16, wherein said second sheet supporting means includes an illuminated display portion formed on a front side extending horizontally in the drawing-out direction and sheet existence/non-existence detection means for detecting the existence or non-existence of sheets in said second sheet supporting means, said illuminated display portion emitting light on the basis of the detection by said sheet existence/non-existence detection means.

24. An image recording apparatus according to any one of claims 16 to 20, further comprising first and second separation means for separating feeding sheets contained in said first and second sheet supporting means, said first separation means comprising friction separation means including rotary feeding means and a friction member, and said second separation means comprising a separating claw for stopping an end corner portion of each contained sheet.

25. A sheet feeding apparatus for supplying sheets to an image recording device, comprising:

first sheet supporting means for supporting manually-stacked sheets, said sheets to be supplied to the image recording device, said first sheet supporting means being mountable to the image recording device so as to be insertable in and drawable from a first side of the image recording device;

sheet feeding means for feeding sheets supported on said first sheet supporting means in the same direction as the direction of mounting of said first sheet supporting means, said sheet feeding means being disposed at a vicinity of a second side of the image recording device opposite to the first side of the image recording device; and a sheet supply unit detachably attached to a lower portion of the image recording device and having second sheet supporting means mountable to the image recording device to be insertable in and drawable from a third side of the image recording device in a direction orthogonal to an inserting and drawing out direction of said first sheet supporting means, said second sheet supporting means also containing manually-stacked sheets, said sheets to be supplied to the image recording device.

26. A sheet feeding apparatus according to claim 25, wherein said first sheet supporting means will support sheets larger than a maximum size sheet supported by said second sheet supporting means.

27. A sheet feeding apparatus according to claim 25, wherein said second sheet supporting means accommodates a larger number of sheets than said first sheet supporting means.

28. A sheet feeding apparatus according to claim 25, further comprising a second sheet supply unit detachably mounted to the image recording device below said sheet supply unit and having a third sheet supporting means mountable to be inserted in and drawn out in the direction of inserting and drawing out of said second sheet supporting means, said third sheet supporting means also containing sheets.

29. A sheet feeding apparatus according to claim 25, wherein said second sheet supporting means has an illuminated display portion formed on a front side so as to extend horizontally in the drawing-out direction, and sheet existence/non-existence detection means for detecting the existence or non-existence of sheets in said second sheet supporting means, said illuminated display portion emitting light on the basis of the detection by said sheet existence/non-existence detection means.

30. An image recording apparatus, comprising:

first sheet supporting means for supporting manually-stacked sheets, said sheets to be supplied to an image recording device, said first sheet supporting means being mountable to the image recording device so as to be insertable in and drawable from a first side of the image recording device;

sheet feeding means for feeding sheets supported on said first sheet supporting means in the same direction as the direction of mounting of said first sheet supporting means, said sheet feeding means being disposed at a vicinity of a second side of the image recording device opposite to the first side of the image recording device;

a sheet supply unit detachably attached to a lower portion of the image recording device and having second sheet supporting means mountable to the image recording device to be insertable in and drawable from a third side of the image recording device in a direction orthogonal to a direction of mounting of said first sheet supporting means, said second sheet supporting means also containing manually-stacked sheets, said sheets to be supplied to the image recording device;

transport means for transporting sheets fed out of said sheet feeding means; and image recording means for recording an image on each sheet transported by said transport means.

31. An image recording apparatus according to claim 30, wherein said first sheet supporting means will support sheets larger than a maximum size sheet supported by said second sheet supporting means.

32. An image recording apparatus according to claim 30, wherein said second sheet supporting means accommodates a larger number of sheets than said first sheet supporting means.

33. An image recording apparatus according to claim 30, further comprising a second sheet supply unit detachably mounted to the image recording device below said sheet supply unit and having a third sheet supporting means mountable to be inserted in and drawn out in the same directions as the direction of inserting in and drawing out of said second sheet supporting means, said third sheet supporting means also containing sheets.

34. An image recording apparatus according to claim 30, wherein said second sheet supporting means has an illuminated display portion formed on a front side so as to extend horizontally in the drawing-out direction, and sheet existence/non-existence detection means for detecting the existence or non-existence of sheets in said second sheet supporting means, said illuminated display portion emitting light on the basis of the detection by said sheet existence/non-existence detection means.

35. A sheet feeding apparatus for supplying sheets to an image recording device, comprising:

first sheet supporting means for supporting sheets to be supplied to the image recording device, said first sheet supporting means being mountable to the image recording device so that it is insertable in and drawable out of the image recording device through a first side portion of the image recording device;

second sheet supporting means for supporting sheets to be supplied to the image recording device, said second sheet supporting means being mountable to the image recording device so that it is insertable in and drawable out of the image recording device through a front portion of the image recording device;

first sheet feeding means for feeding sheets supported on said first sheet supporting means in a mounting direction of said first sheet supporting means, said first sheet feeding means being disposed in a vicinity of a second side portion of the image recording device opposite to the first side portion of the image recording device; and second sheet feeding means for feeding sheets supported on said second sheet supporting means, said second sheet feeding means feeding a sheet in the same direction as a feeding direction of the sheet fed by said first feeding means.

36. A sheet feeding apparatus according to claim 35, wherein said second sheet feeding means is disposed below said first sheet feeding means.

37. An image recording apparatus, comprising:

first sheet supporting means for supporting sheets to be supplied to an image recording device, said first sheet supporting means being mountable to the image recording device so that it is insertable into and drawable out of the image recording device through a first side portion of the image recording device;

second sheet supporting means for supporting sheets to be supplied to the image recording device, said second sheet supporting means being mountable to the image recording device so that it is insertable into and drawable out of the image recording device through a front portion of the image recording device;

first sheet feeding means for feeding sheets supported on said first sheet supporting means in a mounting direction of said first sheet supporting means, said first sheet feeding means being disposed in the vicinity of a second side portion of the image recording device opposite to the first side portion of the image recording device;

second sheet feeding means for feeding sheets supported on said second sheet supporting means, said second sheet feeding means feeding a sheet in the same direction as a feeding direction of the sheet fed by said first sheet feeding means;

transport means for transporting sheets fed by said first sheet feeding means and said second sheet feeding means; and image recording means for recording an image on each sheet transported by said transport means.

* * * * *

UNITED STATES PATENT AND TRADEMARK OFFICE

CERTIFICATE OF CORRECTION

PATENT NO. : 5,732,321
DATED : March 24, 1998
INVENTOR(S) : Haruo ISHIZUKA, et al.

It is certified that error appears in the above-identified patent and that said Letters Patent is hereby corrected as shown below:

Column 12, line 29, delete "2 or 3" and insert therefor --ST2 or ST3--.

Signed and Sealed this

Twenty-seventh Day of October, 1998

*Attest:*

Bruce Lehman

BRUCE LEHMAN

*Attesting Officer*

*Commissioner of Patents and Trademarks*